US006184832B1

(12) United States Patent
Geyh et al.

(10) Patent No.: US 6,184,832 B1
(45) **Date of Patent: *Feb. 6, 2001**

(54) PHASED ARRAY ANTENNA

(75) Inventors: Edward A. Geyh, Groton; Robert P. Zagrodnick, Chelmsford; James E. Rhein, Westboro, all of MA (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/649,374

(22) Filed: May 17, 1996

(51) Int. Cl.[7] ..... H01Q 1/38; H01Q 21/00
(52) U.S. Cl. ..... 343/700 MS; 343/853
(58) Field of Search ..... 343/853, 700 MS, 343/778; H01Q 21/00, 1/38

(56) References Cited

U.S. PATENT DOCUMENTS

| | | | | |
|---|---|---|---|---|
| 5,276,455 | * | 1/1994 | Fitzsimmons et al. | 343/853 |
| 5,293,171 | * | 3/1994 | Cherrette | 343/853 |
| 5,404,145 | * | 4/1995 | Sa et al. | 343/853 |
| 5,459,474 | * | 10/1995 | Mattioli et al. | 343/853 |

OTHER PUBLICATIONS

1995 IEEE MTT–S Digest, Andre' Brunel, et al., Demonstration of Photonically–Controlled GAAS Digital/MMIC for RF Optical Links, pp. 1283–1285.

Reference Data for Radio Engineers 5th Edition, ITT, Digital Computers, Sections 32–21 and 32–22, 1968.

First Annual DARPA/RADC Symposium on Photonics Systems for Antenna Applications, Dec. 13–14, 1990, Monteray, CA, C. P. McClay, et al., Microwave Optical Integrated Circuit for Phased Array Antennas.

IEEE Transactions on Microwave Theory and Techniques vol. 38, No. 5, May 1990, Peter J. Heim, et al., Frequency Division Multiplex Microwave and Baseband Digital Optical Fiber Link for Phased Array Antennas, pp. 494–500.

(List continued on next page.)

*Primary Examiner*—Michael C. Wimer
(74) *Attorney, Agent, or Firm*—Daly, Crowley & Mofford, LLP

(57) ABSTRACT

A phased array antenna having an array of antenna elements, an array of phase shifter sections, each one thereof being associated with a corresponding one of the antenna elements, and a cold-plate having a pair of surfaces, one of the surfaces having the array of phase shifter sections mounted, and thermally coupled, thereto and an opposite one of the pair of surfaces having thermally conductive posts projecting outwardly therefrom, each one of the posts being disposed behind a corresponding one of the plurality of mounted phase shifter sections. A heat sink plate is thermally coupled to distal ends of the posts. The cold-plate has a plurality of feeds passing therethrough. The phased array antenna includes a power/radio frequency energy distribution section mounted to said opposite one of the pair of cold plate surfaces for distributing power and radio frequency energy among the phase shifter sections mounted to the cold plate. The radio frequency energy distribution section comprises a plurality of stacked printed circuit boards and the posts pass through the stacked printed circuit boards to the heat sink plate and radio frequency energy is coupled to the phase shifter section though coupling power dividers and slots provided in the stacked, power/radio frequency energy distribution section printed circuit boards. An array of antenna elements is provided having an array of patch radiators. A conductive layer is provided having an array of cavities disposed therein, each one of the patch radiators being disposed over an associated one of the cavities.

23 Claims, 19 Drawing Sheets

OTHER PUBLICATIONS

IEEE Photonics Technology Letters, vol. 4, No. 7, Jul. 1992, Y. Akahori, et al., 10–Gb/s High–Speed Monolithically Integrated Photoreceiver Using InGaAs p–i–n PD and Planar Doped InA1As/InGaAs HEMT's, pp. 754–756.

IEEE Photonics Technology Letters, vol. 7, No. 2, Feb. 1995, L. M. Lunardi, et al., A 12–Gb/s High Performance, High–Sensitivity Monolithic p–i–n/HBT Photoreceiver Module for Long–Wavelength Transmission Systems, pp. 182–184.

* cited by examiner

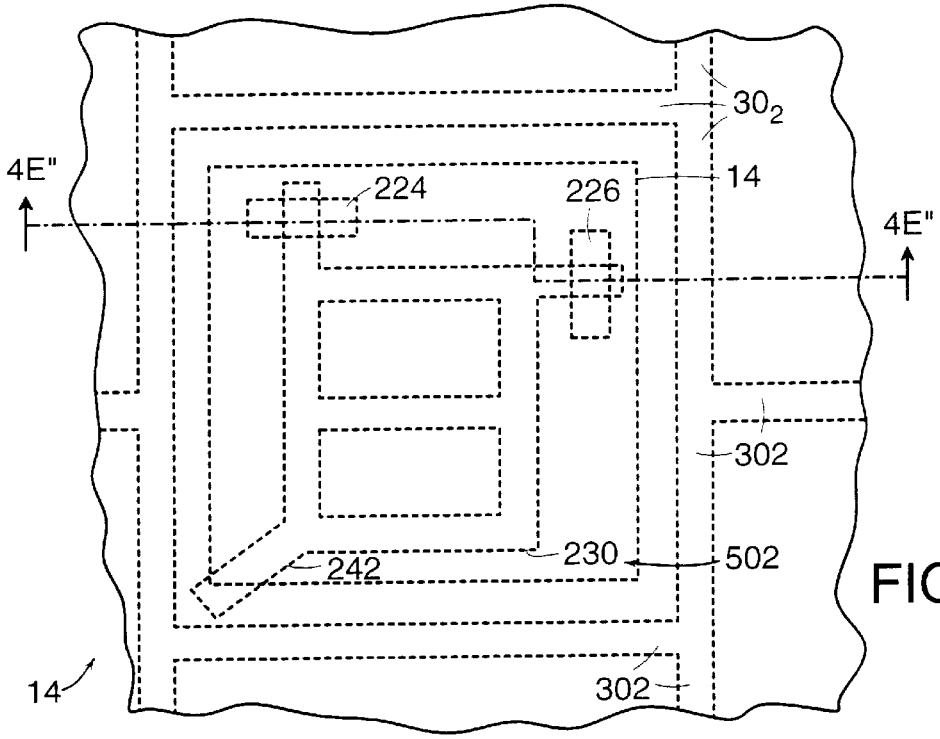
FIG. 4E'
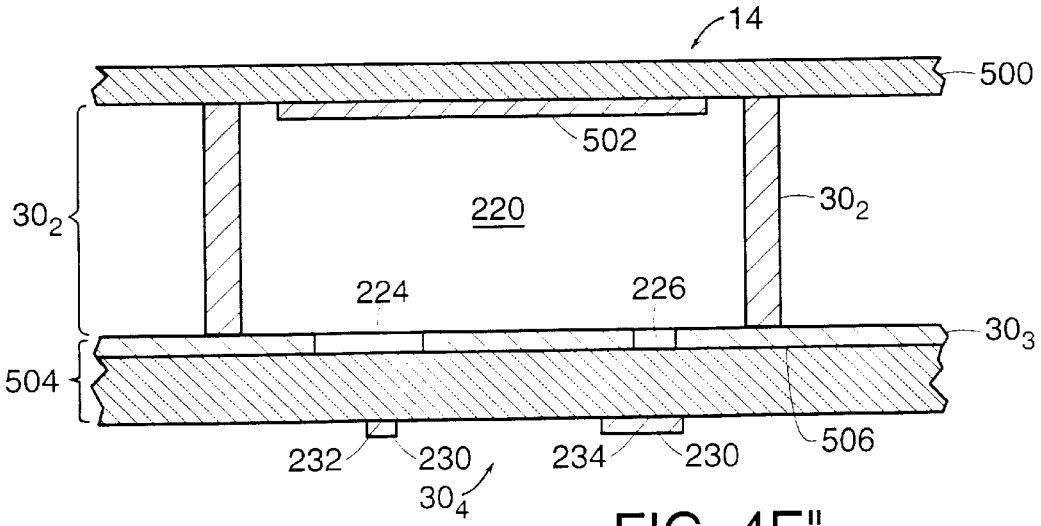
FIG. 4E"

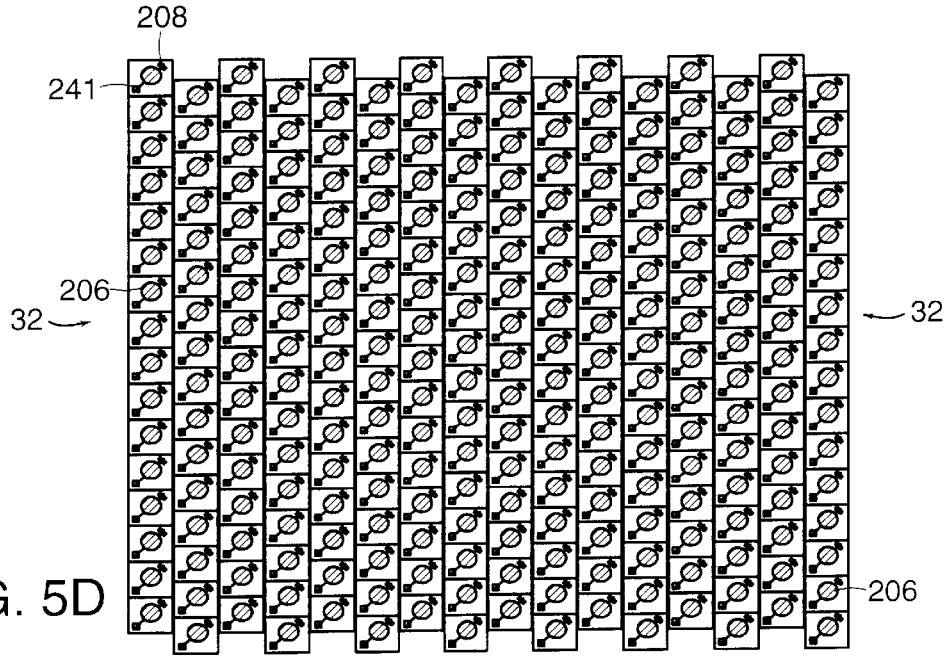
FIG. 5D
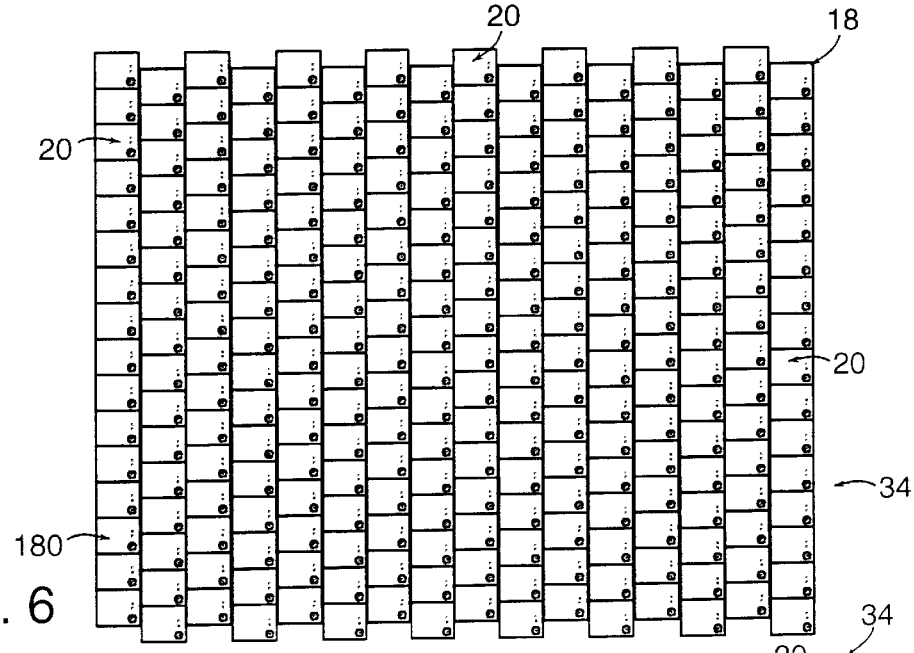
FIG. 6
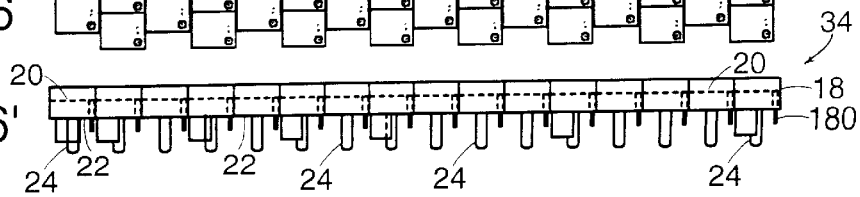
FIG. 6'
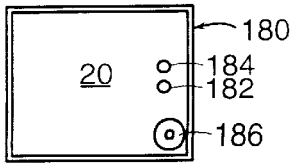
FIG. 6"

PHASED ARRAY ANTENNA

BACKGROUND OF THE INVENTION

This invention relates generally to phased array antennas and more particularly to phase array antennas adapted for volume production and having effective, compact cooling structures for active elements in the phase shifter sections used in the phased array antenna.

As is known in the art, phased array antenna systems are adapted to produce a beam of radio frequency energy (RF) and direct such beam along a selected direction by controlling the phase of the energy passing between a transmitter/receiver and an array of antenna elements through a plurality of phase shifter sections. This direction is provided by sending a control word (i.e., data representative of the desired phase shift, as well as attenuation and other control data such as a strobe signal) to each of the phase shifter sections.

As is also known in the art, it is desirable to provide phase array antennas adapted for high volume production and having effective, compact cooling structures for active elements in the phase shifter sections used in the array antenna.

SUMMARY OF THE INVENTION

In accordance with the present invention, a phased array antenna is provided having an array of antenna elements, an array of phase shifter sections, each one thereof being associated with a corresponding one of the antenna elements, and a cold-plate having a pair of surfaces, one of the surfaces having the array of phase shifter sections mounted, and thermally coupled, thereto and an opposite one of the pair of surfaces having thermally conductive posts projecting outwardly therefrom, each one of the posts being disposed behind a corresponding one of the plurality of mounted phase shifter sections. A heat sink plate is thermally coupled to distal ends of the posts.

In accordance with another feature of the invention, the cold-plate has a plurality of feeds passing therethrough. A set of such feeds is associated with a corresponding one of the phase shifter sections. A pair of such feeds in each set thereof is adapted to provide power to the associated one of the phase shifter sections and another one of the feeds in the set thereof is adapted to couple therethrough radio frequency energy associated with such one of the phase shifter sections.

In accordance with still another feature of the invention, the phased array antenna includes a power/radio frequency energy distribution section mounted to said opposite one of the pair of cold-plate surfaces for distributing power and radio frequency energy among the phase shifter sections mounted to the cold-plate. The radio frequency energy distribution section comprises a plurality of stacked printed circuit boards and the posts pass through the stacked printed circuit boards to the heat sink plate.

In accordance with still another feature of the invention, the array of antenna elements are arranged in columns and one of the stacked, power/radio frequency energy distribution section printed circuit boards includes a plurality of voltage buses disposed in columns and an additional bus disposed obliquely to, and electrically interconnecting, the plurality of voltage buses.

In accordance with still another feature of the invention the heat sink plate has a radio frequency connector and the power/radio frequency energy distribution section is coupled to the radio frequency connector and radio frequency energy fed to the radio frequency connector is coupled to the phase shifter section through power dividers and coupling slots provided in the stacked, power/radio frequency energy distribution section printed circuit boards.

In accordance with another feature of the invention, an array of antenna elements is provided having an array of patch radiators. A conductive layer is provided with an array of cavities, each one of the patch radiators being disposed over an associated one of the cavities.

In a preferred embodiment, an RF feed is provide for each one of the cavities. Each RF feed includes a pair of orthognal slots.

BRIEF DESCRIPTION OF THE DRAWING

Other features of the invention, as well as the invention itself, will become more readily apparent when read together with the detailed description taken together with the accompanying drawings, in which:

FIG. 4 is a perspective exploded view of the front end layer section, FIG. 4A is a plan view of an air-filled cavity layer, FIG. 4A' is a side elevation view of the air-filled cavity layer.

FIG. 4E' is a plan view of an exemplary one of an array of antenna elements used in the front end section of FIG. 4, the plan view in FIG. 4E' showing a patch radiator element used in such exemplary antenna element, a portion of the air-filled cavity layer associated with the patch radiator element, a pair of slots of the circular polarized layer associated with the patch radiator element, and portions of a hybrid of the hybrid layer used to feed the slots;

FIG. 4E" is a cross-sectional elevation view of the exemplary one of the antenna elements of FIG. 4E', such cross section being taken along line 4E"—4E" of FIG. 4E';

FIG. 5 is a perspective exploded view of the isolator layer section, FIG. 5A is a plan view of a spacer layer, FIG. 5A' is a plan view of the spacer layer, FIG. 5D is a plan view of the isolator layer section;

FIGS. 6, 6', 6A and 6B are diagrammatical sketches of an active components layer section (or cold-plate) used in the phased array subassembly of FIG. 1A, FIG. 6 is a plan view of the cold-plate, FIG. 6' is a side elevation view of the cold-plate, FIG. 6" an enlarged view of an exemplary one of a plurality of pockets formed in the cold-plate.

FIG. 7 is a perspective exploded view of the DC/RF distribution layer section, FIG. 7A is a plan view of an RF distribution layer, FIG. 7B is a plan view of a ground plan layer, FIG. 7C is a plan view of a +5 Volt bus layer, FIG. 7D is a plan view of a −5 Volt bus layer and 7E is a plan view of the RF/DC distribution layer section;

FIG. 8 is a perspective exploded view of the RF manifold layer section, FIG. 8A is a plan view of an input feed/connector layer, FIG. 8B is a plan view of an input slot coupler layer, FIG. 8C is a plan view of a combiner layer, FIG. 8D is a plan view of a slot coupled layer, and FIG. 8E is a plan view of the RF manifold section;

FIG. 9 is a plan view and FIG. 9' is a side elevation view;

FIG. 9" is a rear plan view of an array of the heat sink plates of FIGS. 9 and 9';

DESCRIPTION OF THE PREFERRED EMBODIMENTS

Figure 1:
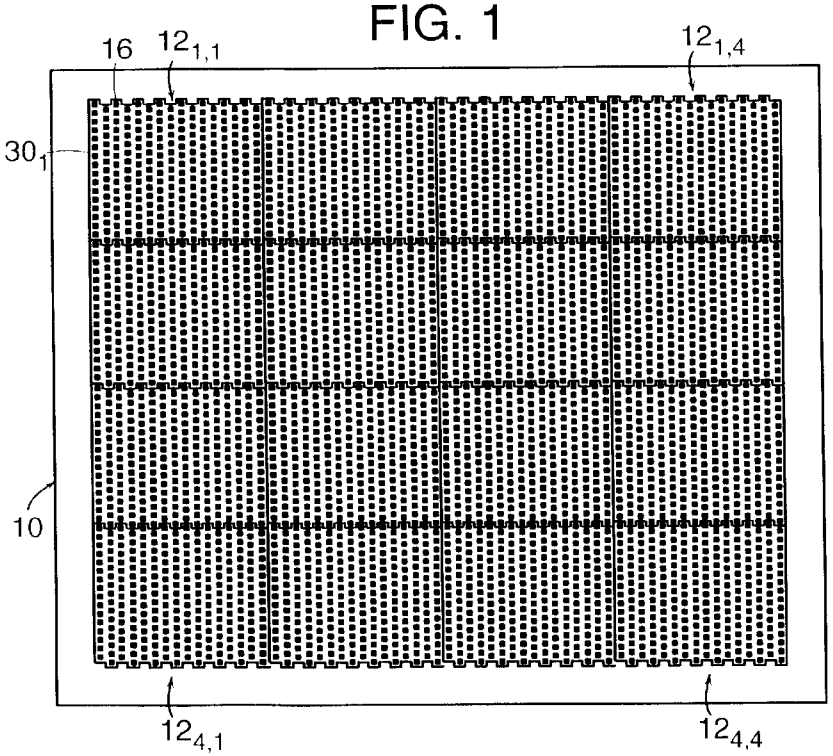
FIG. 1 is a plan view of a phased array antenna according to the invention.
Figure 1A:
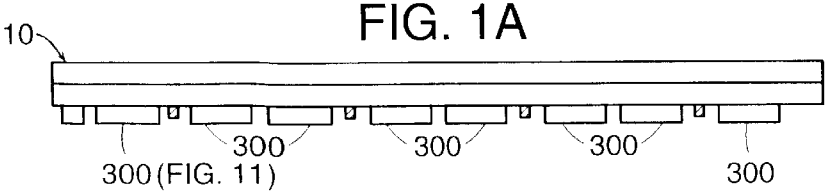
FIG. 1A' is a side elevation view of the phased array antenna of FIG. 1.

Referring now to FIGS. 1, 1A', 2 and 2A', a phased array antenna 10 is shown, here having a four by four array of phased array subassemblies $\mathbf{12}_{1,1}$, through $\mathbf{12}_{4,4}$, as shown. Each one of the subassemblies $\mathbf{12}_{1,1}$, through $\mathbf{12}_{4,4}$ is substantially identical in construction, an exemplary one thereof, here subassembly $\mathbf{12}_{1,1}$ being shown in more detail in FIGS. 2 and 2A'. Thus, referring to exemplary phase shifter subassembly $\mathbf{12}_{1,1}$, such subassembly $\mathbf{12}_{1,1}$ includes an array of antenna elements 14, here patch radiators, an array of phase shifter sections 16 (FIG. 2A), each one thereof being associated with, and disposed behind, a corresponding one of the antenna elements 14; a cold-plate 18 (sometimes also referred to herein as the active components layer section 34) having a pair of, here upper and bottom, surfaces 20, 22, respectively, the upper surface 20 having the array of phase shifter sections 16 mounted, and thermally coupled, thereto and an opposite, bottom, surface 22 having thermally conductive posts 24 projecting outwardly therefrom, each one of the thermally conductive posts 24 being disposed behind a corresponding one of the plurality of mounted phase shifter sections 16; and, a heat sink plate 28 thermally coupled, here soldered, to distal ends 30 of the thermally posts 24.

Figure 3:
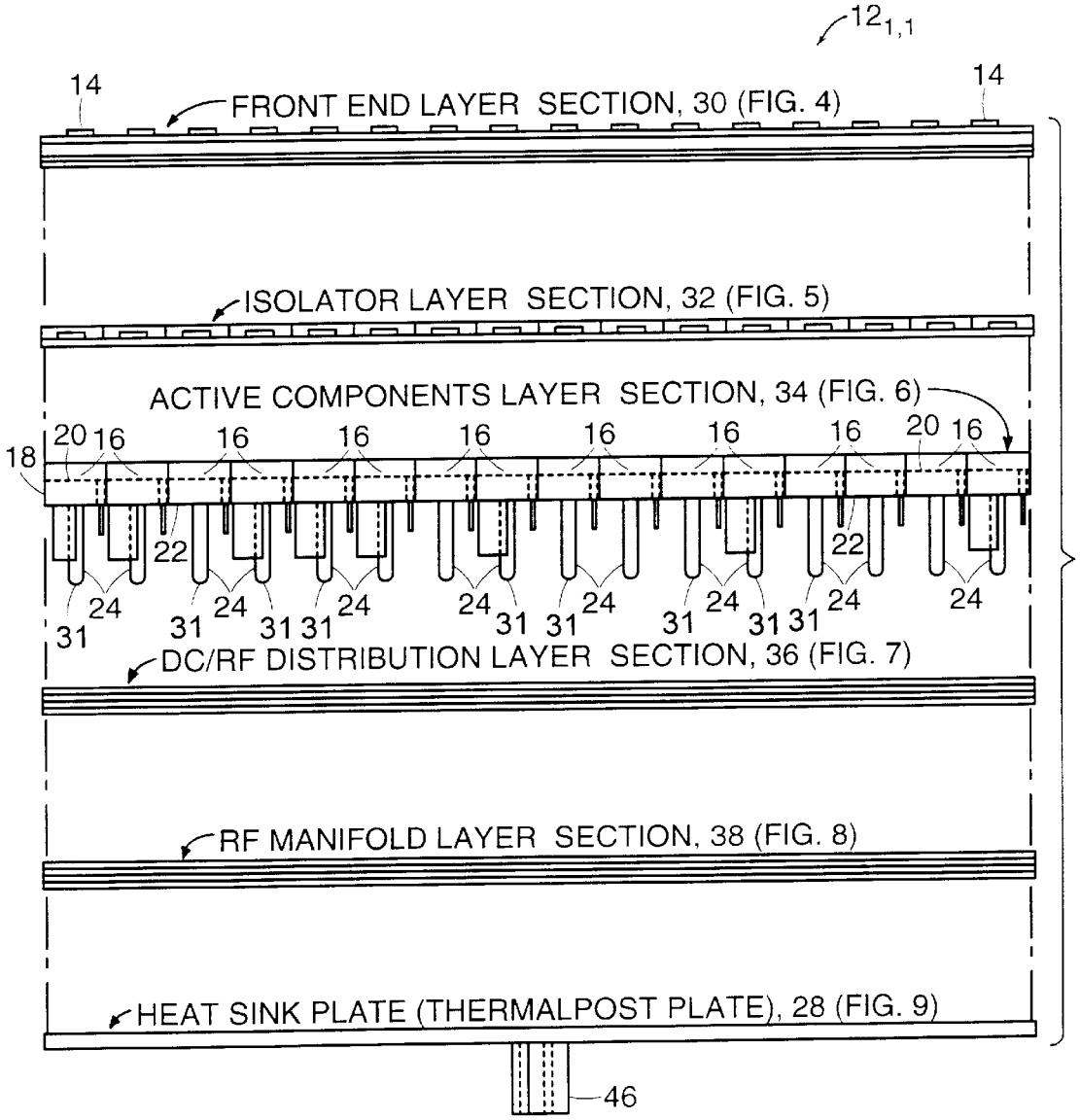
FIG. 3 is an exploded view of the phased array subassembly of FIG. 1A'.
Figure 4:
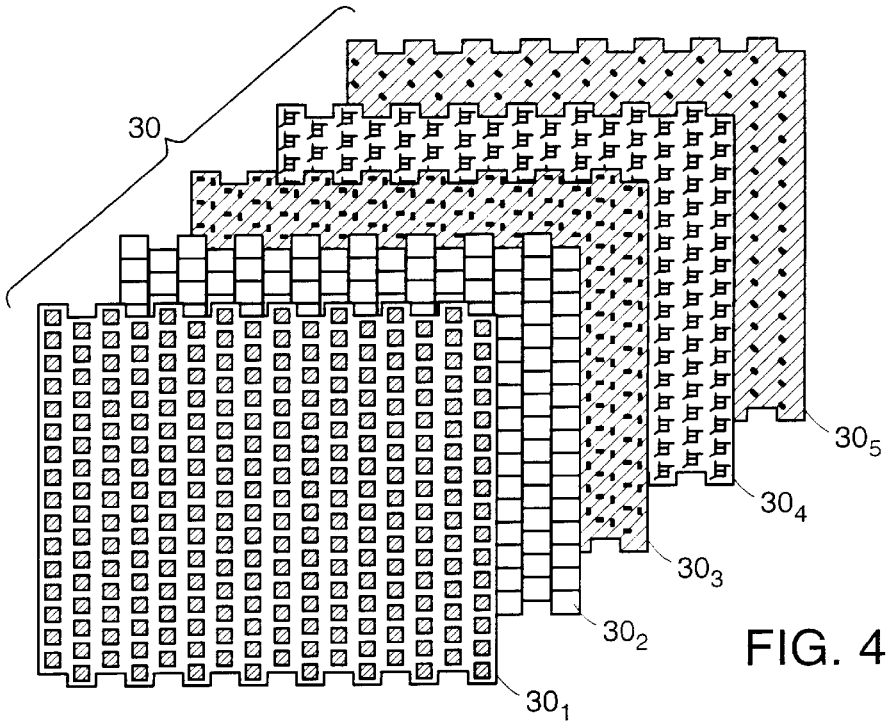
FIGS. 4, 4A, 4A', 4B, 4C, 4D, and 4E are diagrammatical sketches of a front end layer section used in the phased array subassembly of FIG. 1A.
Figure 4A:
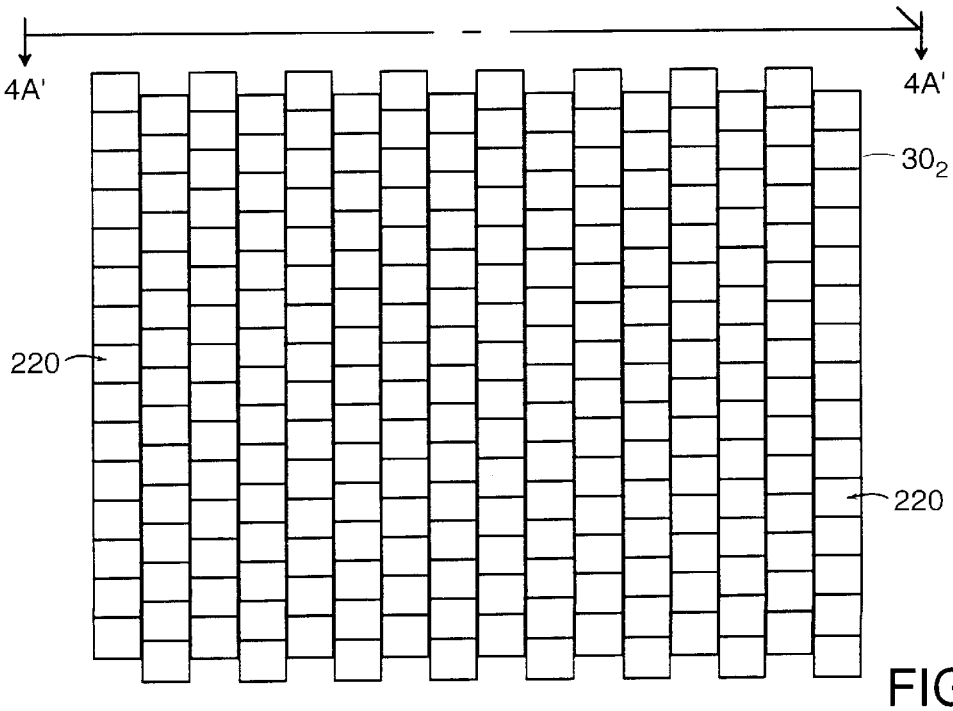
Figure 4A:
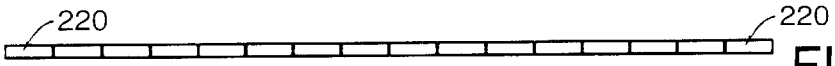
Figure 5:
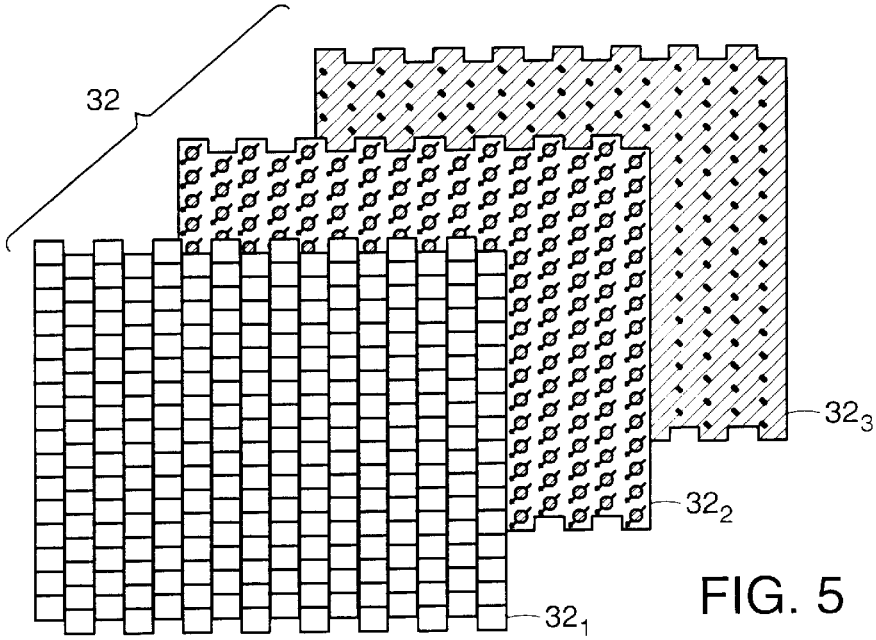
FIGS. 5, 5A, 5A', 5B, 5B', 5C, and 5D are diagrammatical sketches of an isolator layer section used in the phased array subassembly of FIG. 1A.
Figure 5A:
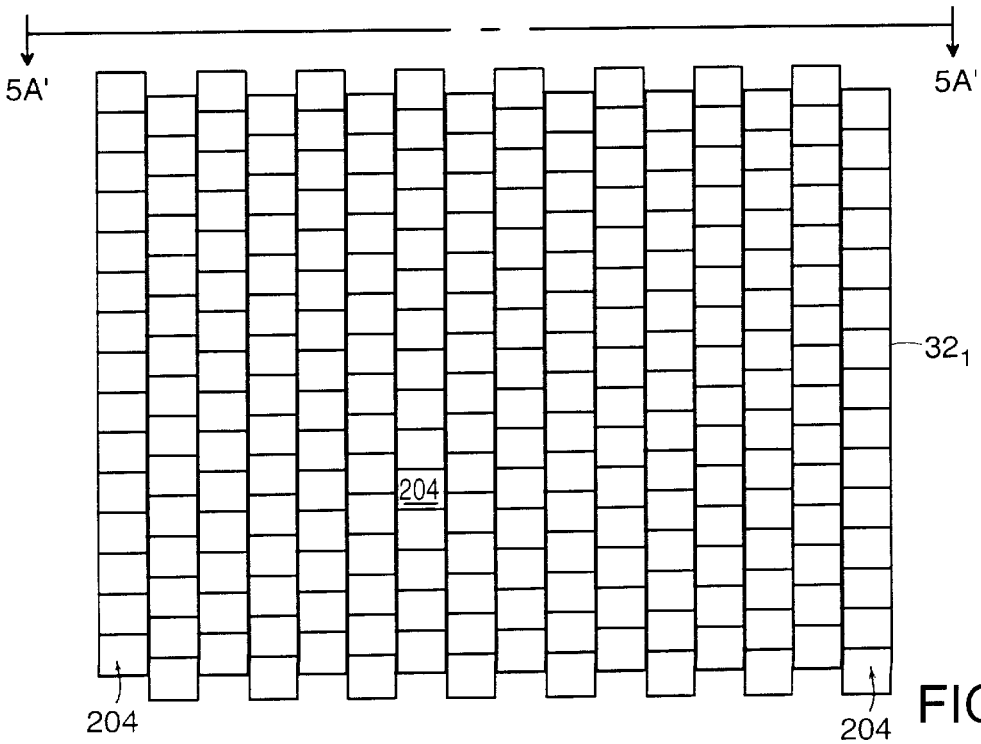
Figure 5A:
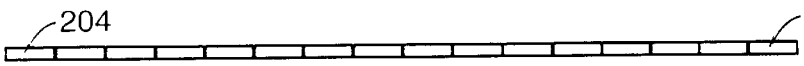
Figure 6A:
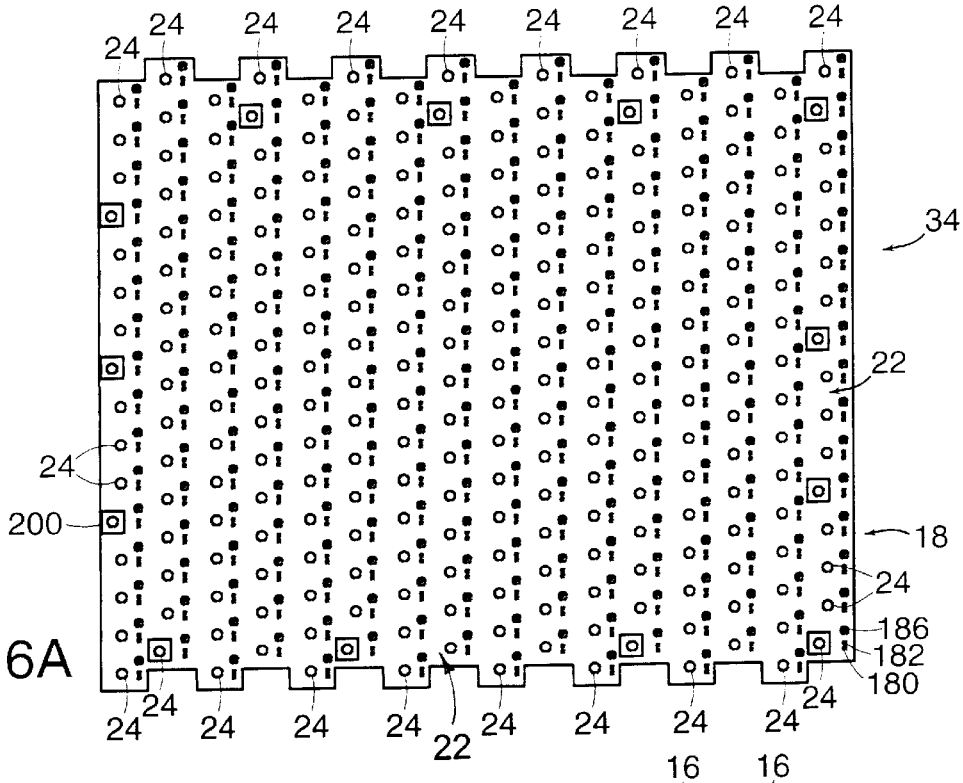
FIG. 6A is a rear view plan view of the cold-plate.
Figure 6B:
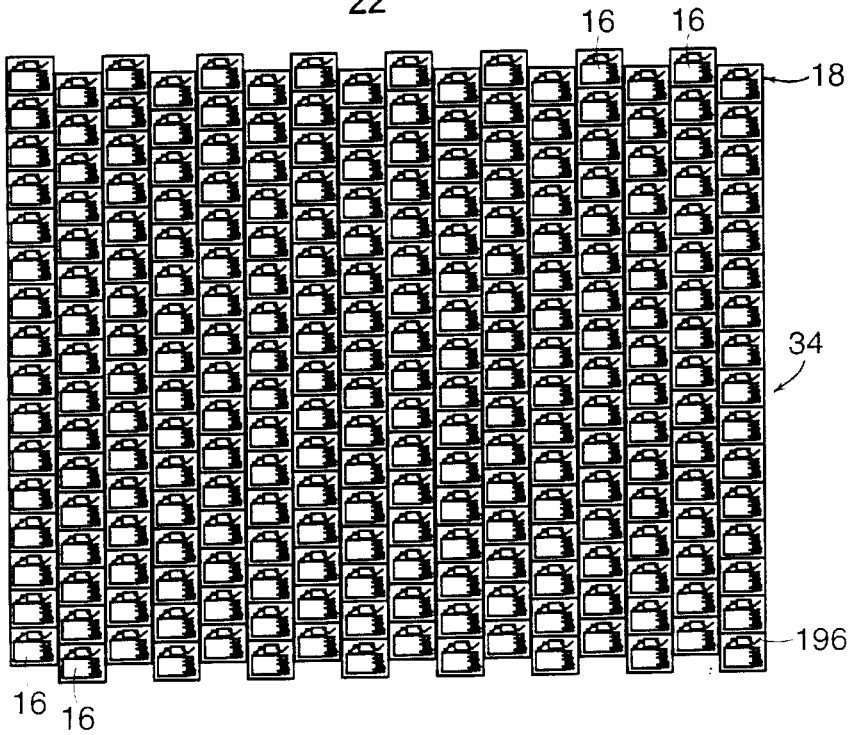
FIG. 6B is a top view of the cold-plate with phase shifter sections disposed in the pockets thereof.
Figure 6C:
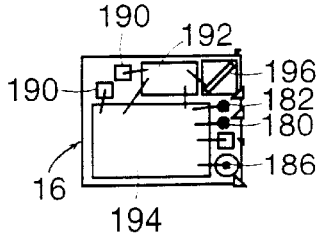
FIG. 6C is an plan view of an exemplary one of the phase shifter sections used in the antenna of FIG. 1.
Figure 8:
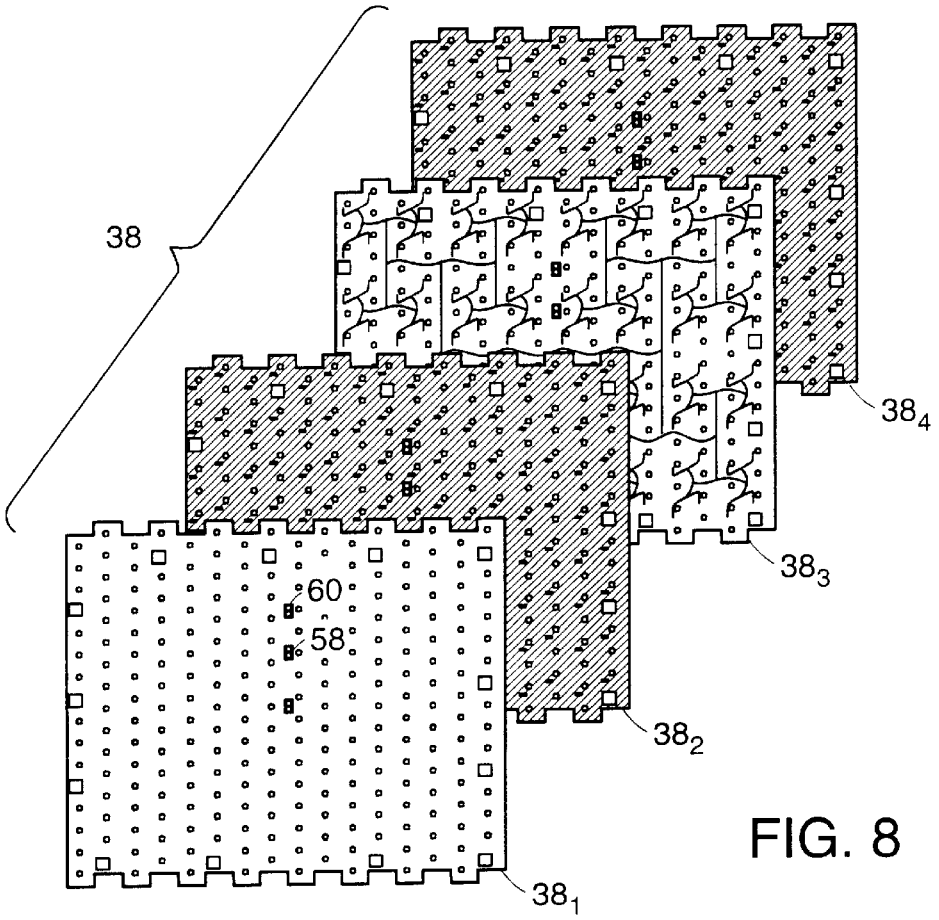
FIGS. 8, 8A, 8B, 8C, 8D and 8E are diagrammatical sketches of an RF manifold section used in the phased array subassembly of FIG. 1A.
Figure 8A:
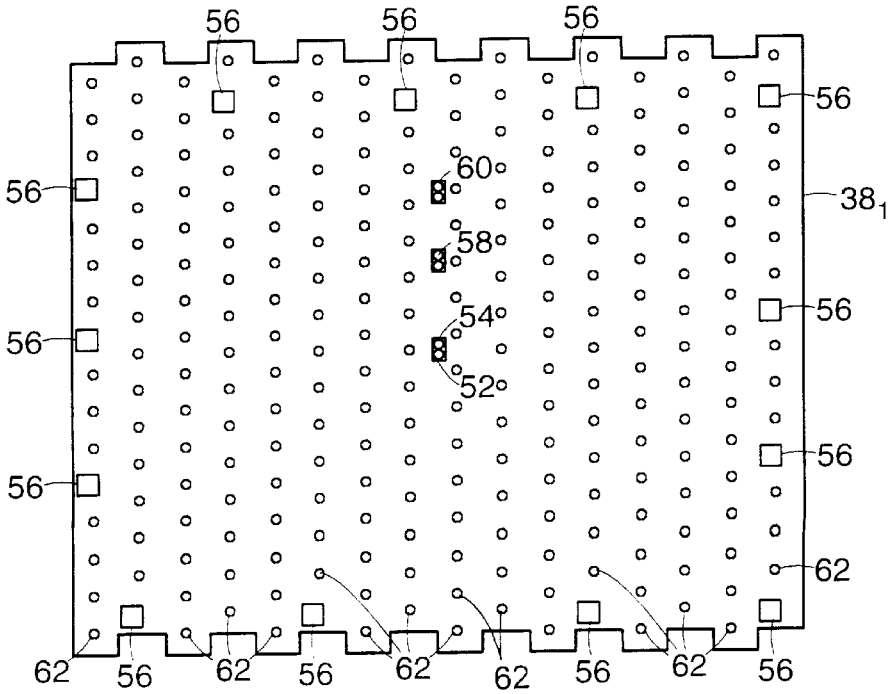
Figure 8B:
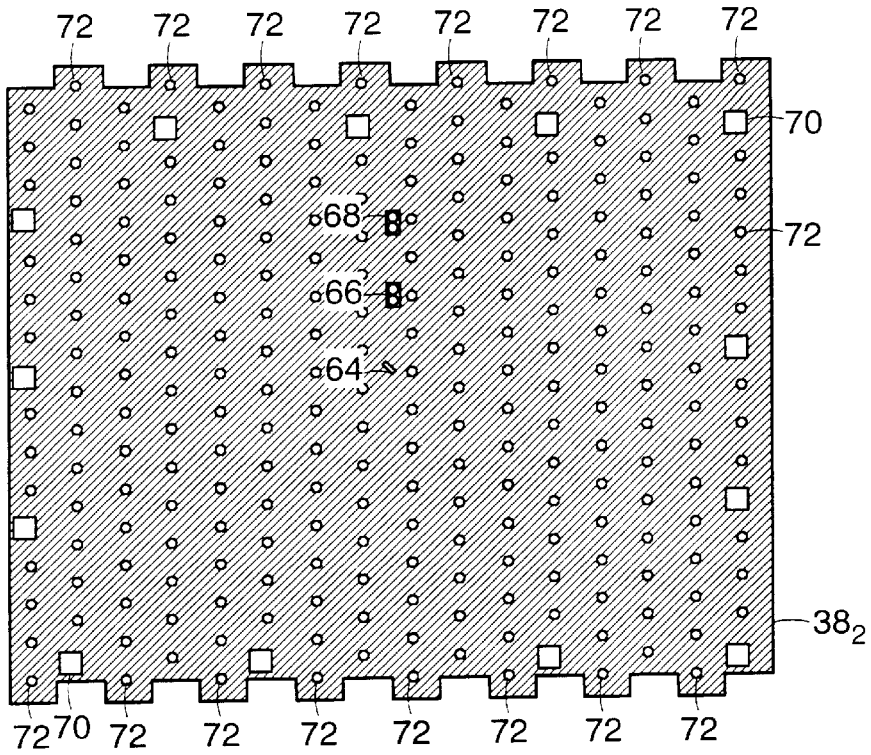
Figure 8C:
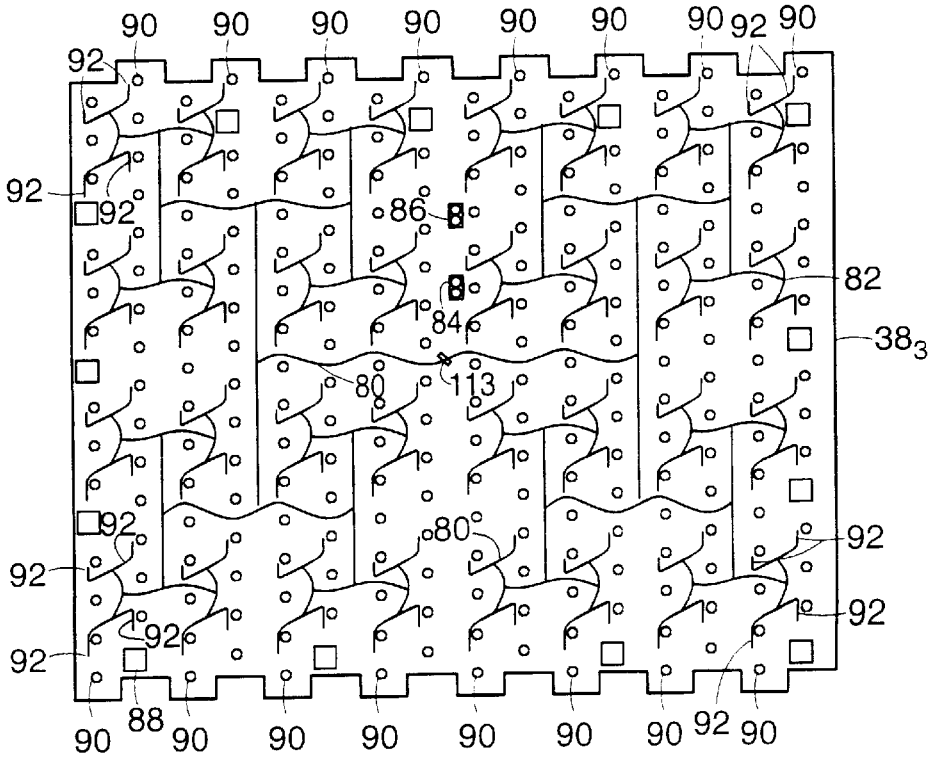
Figure 8D:
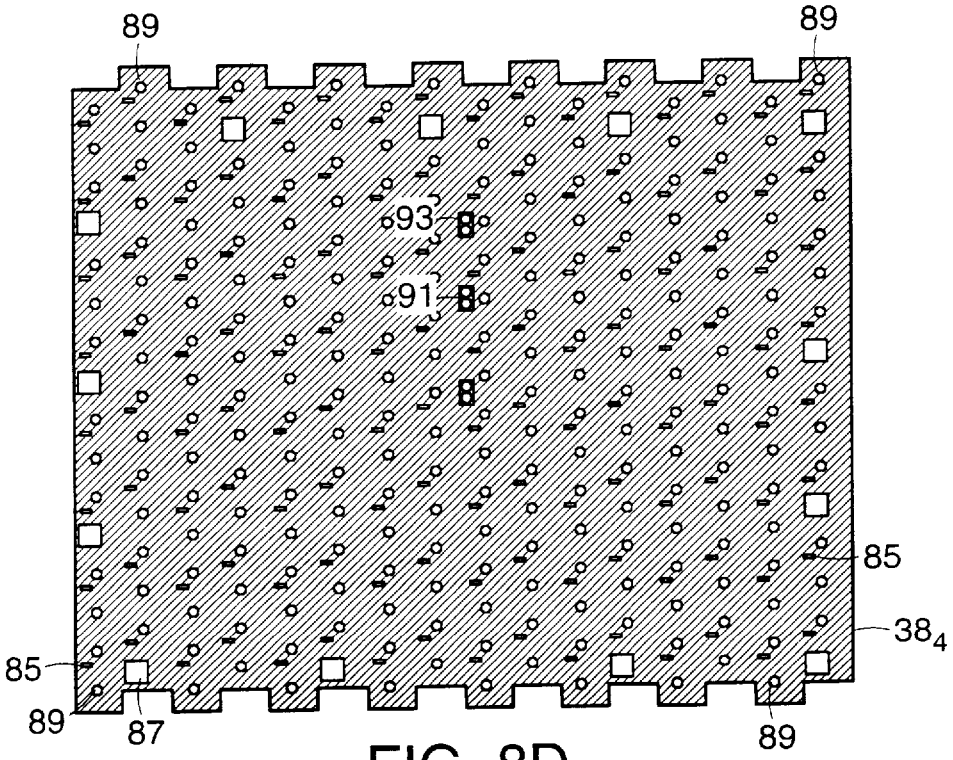
Figure 8E:
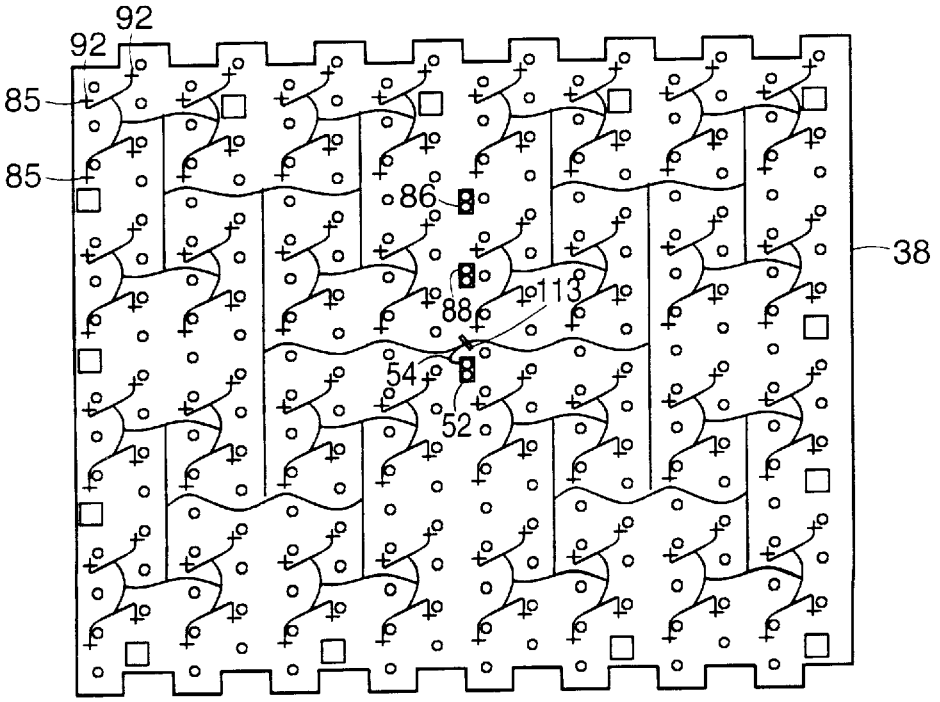
Figure 9:
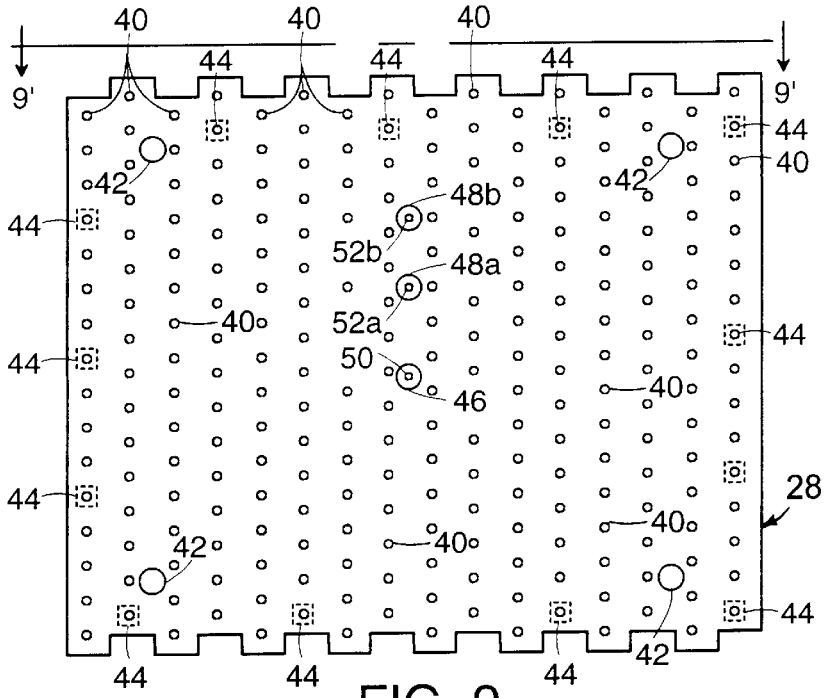
FIGS. 9 and 9' are diagrammatical sketches of a heat sink plate used in the phased array subassembly of FIG. 1A.
Figure 9:
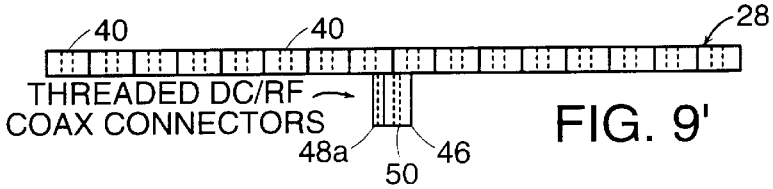
Figure 9:
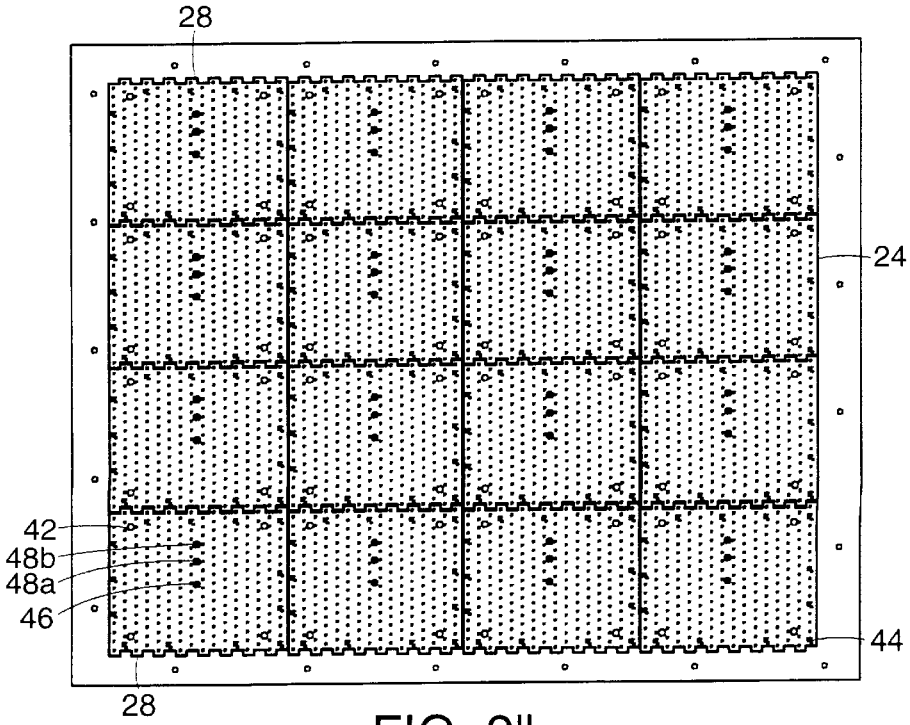

Referring also to FIG. 3, the exemplary phased array subassembly $\mathbf{12}_{1,1}$ includes:

(1) a front end layer section 30, here a multi-level printed circuit board, having the patch antenna elements 14 on the upper surface thereof, such section 30 being shown in more detail in FIGS. 4, 4A, 4A', 4B, 4C, 4D, and 4E;

(2) an isolator layer section, 32, here a multi-level printed circuit board, shown in more detail in FIGS. 5, 5A, 5A', 5B, 5C, and 5D;

(3) the active components layer section 34, such layer 34 including the plurality of phase shifter sections 16, a section 34 being shown in more detail in FIGS. 6, 6', 6", 6A and 6B, such section 34 having mounted and thermally coupled to the upper surface 20 thereof, the plurality of active phase shifter sections 16 (an exemplary one of such phase shifter sections 16 being shown in FIG. 6C);

(4) a DC/RF distribution layer section 36, here a multi-level printed circuit board shown in detail in FIGS. 7, 7A, 7B, 7C, 7D, and 7E;

(5) an RF manifold section 38, here a multi-level printed circuit board shown in detail in FIGS. 8, 8A, 8B, 8C, 8D and 8E; and, (6) the heat sink plate 28 (or thermal post plate), shown in detail in FIGS. 9, 9' and 9", all arranged in a stacked relationship, as indicated.

Figure 10:
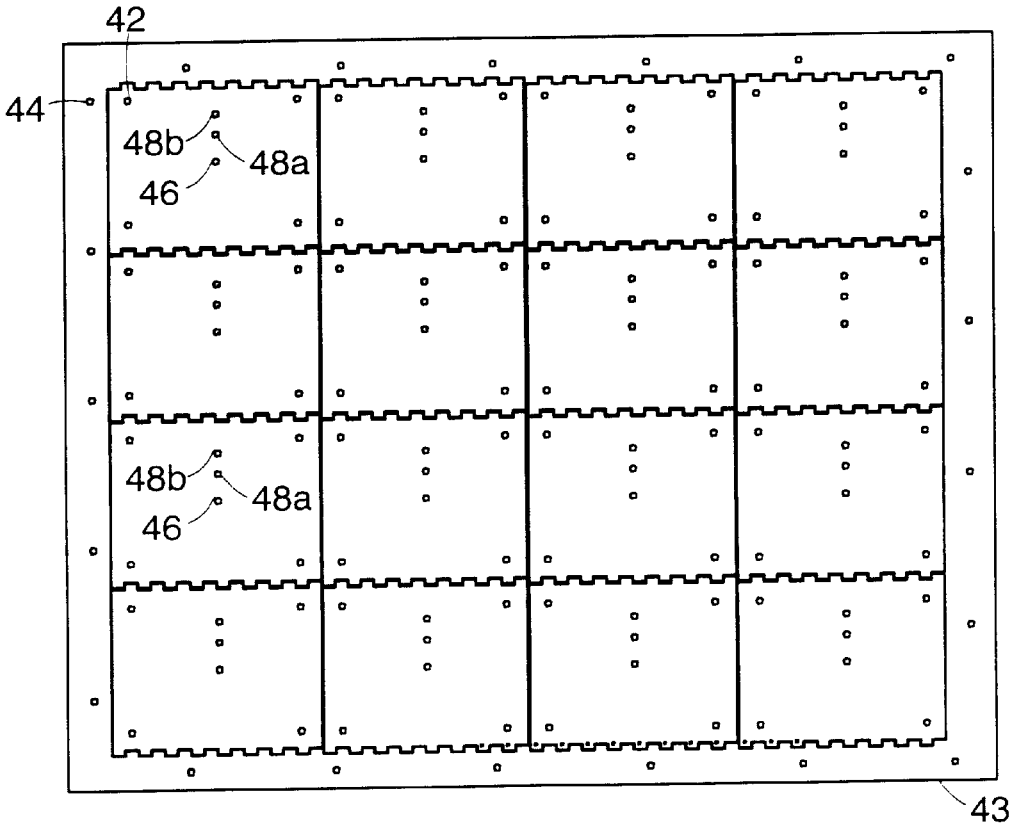
FIG. 10 is a rear view of a back plate used for the array of heat sink plates of FIG. 9"

Referring first to the heat sink plate 28 (FIGS. 9 and 9') and describing the array antenna 10 in the transmit mode, it being understood that the antenna 10 operates in a reciprocal manner during the receive mode, the heat sink plate 28 is a thermally and electrically conductive member having an array of, here 16 columns of, holes 40 therethrough, such holes 40 being provided to receive the distal ends 31 (FIG. 3) of thermally conductive posts 24 (FIG. 3) which are soldered, or welded, or otherwise thermally conductively attached to the heat sink plate 28 to provide a good thermal contact to such heat sink plate 28. Thus, each one of the holes is in registration with an associated one of the phase shifter sections 16 and an associated one of the antenna elements 14. Four larger female threaded holes 42 also pass through the heat sink plate for mounting to a back-plate 43 (FIG. 10) for the sixteen phased array subassemblies $\mathbf{12}_{1,1}$–$\mathbf{12}_{4,4}$ shown in FIG. 9". Additional holes 44 are provided for mounting the subarray $\mathbf{12}_{1,1}$ backplate 43 to the cold plate 20 (FIG. 6A).

An RF threaded coaxial connector 46 is affixed to the thermal post plate 28 and backplate 43, as shown, to couple RF to, or from, the antenna elements 14 via the phase shifter sections 16 (FIG. 3), in a manner to be described. A pair of threaded coaxial DC connectors 48*a*, 48*b* are also provided for supplying DC power to the phase shifter sections 16, in a manner to be described. Each of the connectors 46, 52*a*, 52*b* is a coaxial connector having its outer conductor connected to the heat sink plate 28, which serves as an RF and DC ground. Here, connector 48*a* provides +5 Volts and connector 48*b* provides −5 Volts via center conductors 48*a*, 48*b*, respectively. The center conductor of the RF connector 46 is indicated by numeral 50.

Referring now to FIG. 8 the RF manifold layer section 38 is shown to include: an input feed/connector layer $\mathbf{38}_1$ (FIG. 8A), an input slot coupler layer $\mathbf{38}_2$ (FIG. 8B), a combiner layer $\mathbf{38}_3$ (FIG. 8C), and a slot coupled layer $\mathbf{38}_4$ (FIG. 8D). FIG. 8E shows the overlaying relationship among the layers $\mathbf{38}_1$–$\mathbf{38}_4$ when assembled. Thus, referring first to FIG. 8A, the input feed/connector layer $\mathbf{38}_1$ is a printed circuit board having a conductive input connector pad 52, a conductive input fed line 54, cutouts 56 for cold-plate 18 mounting hardware (not shown), a conductive pad which passes through the printed circuit board (hereinafter referred to as a pad/plated through-hole) 58 for the +5 Volt DC connector 48*a*, a pad/plated through-hole 60 for the −5 Volt DC connector 48*b*, and 16 columns of holes 62 for the thermally conductive posts 24 (FIG. 1A).

Referring to FIG. 8B, the input slot coupler layer $\mathbf{38}_2$ is a conductive layer on a printed circuit board having an output combiner slot 64 formed in such conductive layer, a pad/ plated through-hole 66 for the +5 Volt DC connector 48*a*, a pad/plated through-hole 68 for the −5 Volt DC connector 48*b*, cutouts 70 for cold-plate 18 mounting hardware (not shown), and 16 columns of holes 72 for the thermally conductive posts 24 (FIG. 1A).

Referring now to FIG. 8C, the combiner layer $\mathbf{38}_3$ is a printed circuit board having a pattern of strip conductors 80 formed thereon, as shown, to provide a power combiner/divider, here a 128:1 power combiner/dividers 82. The combiner layer $\mathbf{38}_3$ has a pad/plated through-hole 84 for the +5 Volt DC connector 48*a*, a pad/plated through-hole 86 for the −5 Volt DC connector 48*b*, cutouts 88 for cold-plate 18 mounting hardware (not shown), and 16 columns of holes 90 for the thermally conductive posts 24 (FIG. 1A). Referring to FIG. 8D, the slot coupled layer $\mathbf{38}_4$ is a printed circuit board having a conductive layer with 16 columns of slots 85 formed therein. The slots 85 are in registration with the ends 92 of the power combiner/dividers 82. As shown in FIG. 8E, the input feed line 54, output combiner slot 64, and center region 113 of the strip conductor 80 pattern are in registration with each other; i.e., in overlaying relationship, albeit that the strip conductor 80 is separated from the feed line 54 and the conductive layer having the slots 64 formed therein by the dielectric of the printed circuit boards of layers $\mathbf{38}_2$, $\mathbf{38}_3$. Thus, during transmission, RF energy is coupled via feed line 54 to the center region 113 and such RF energy is then distributed to distal ends 92 of the power divider/combiner 82.

Figure 7:
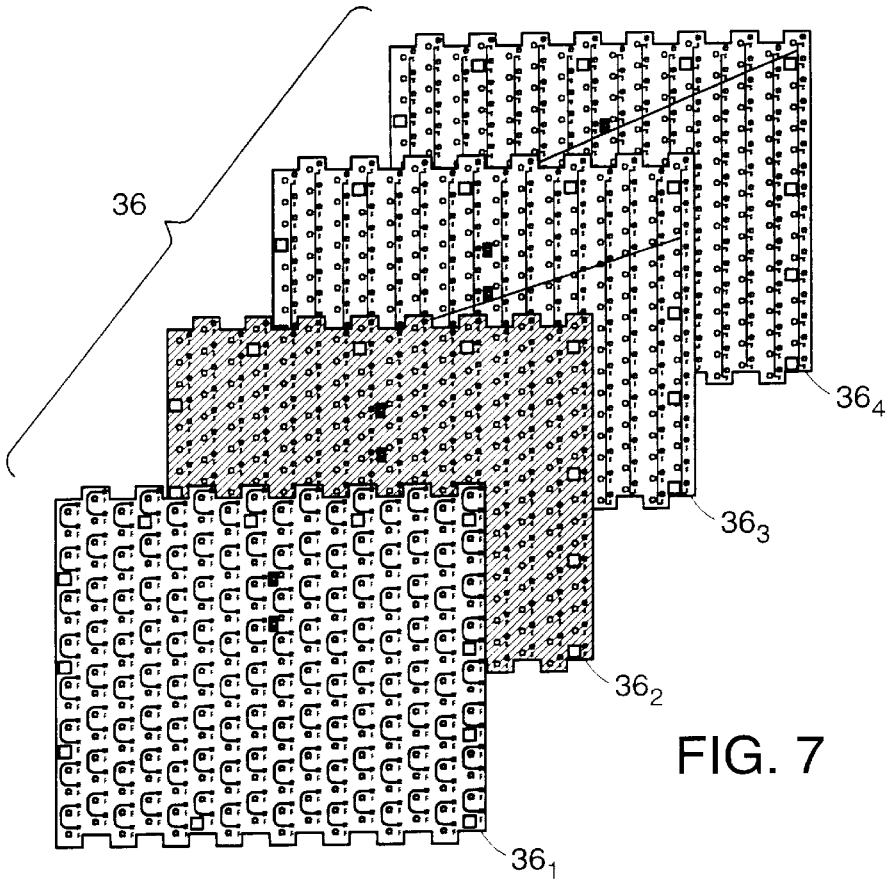
FIGS. 7, 7A, 7B, 7C, 7D, and 7E are diagrammatical sketches of a DC/RF distribution layer section used in the phased array subassembly of FIG. 1A.
Figure 7A:
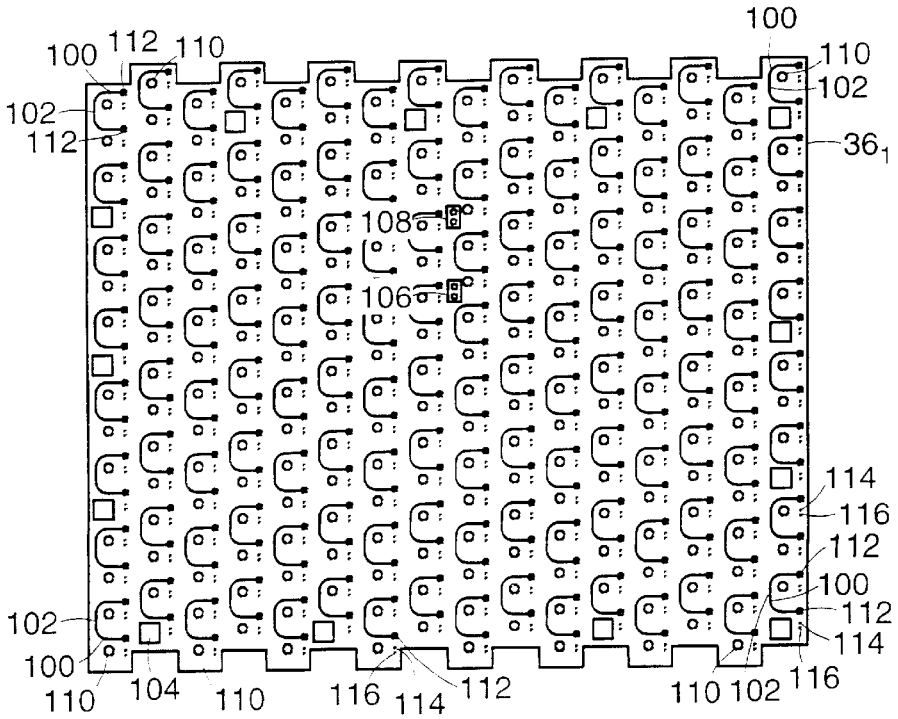
Figure 7B:
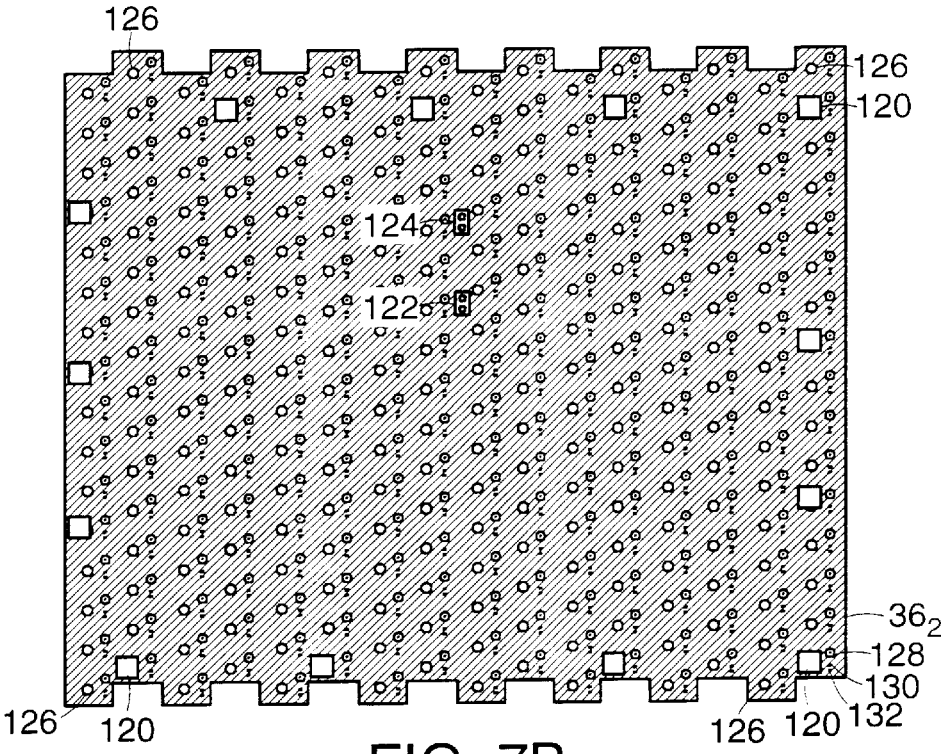
Figure 7C:
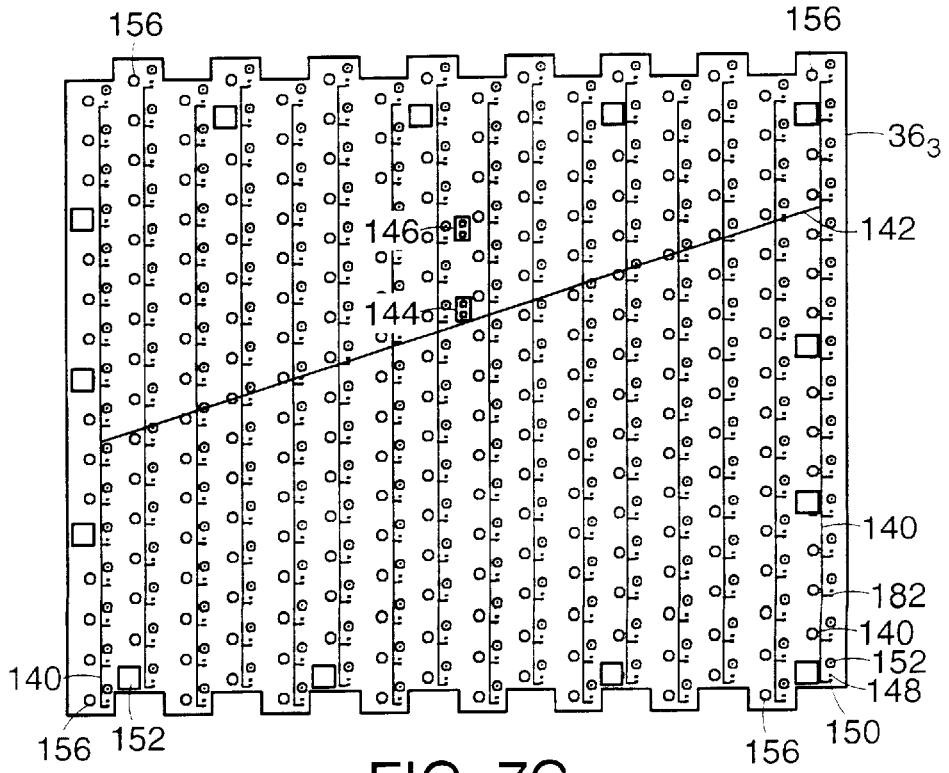
Figure 7D:
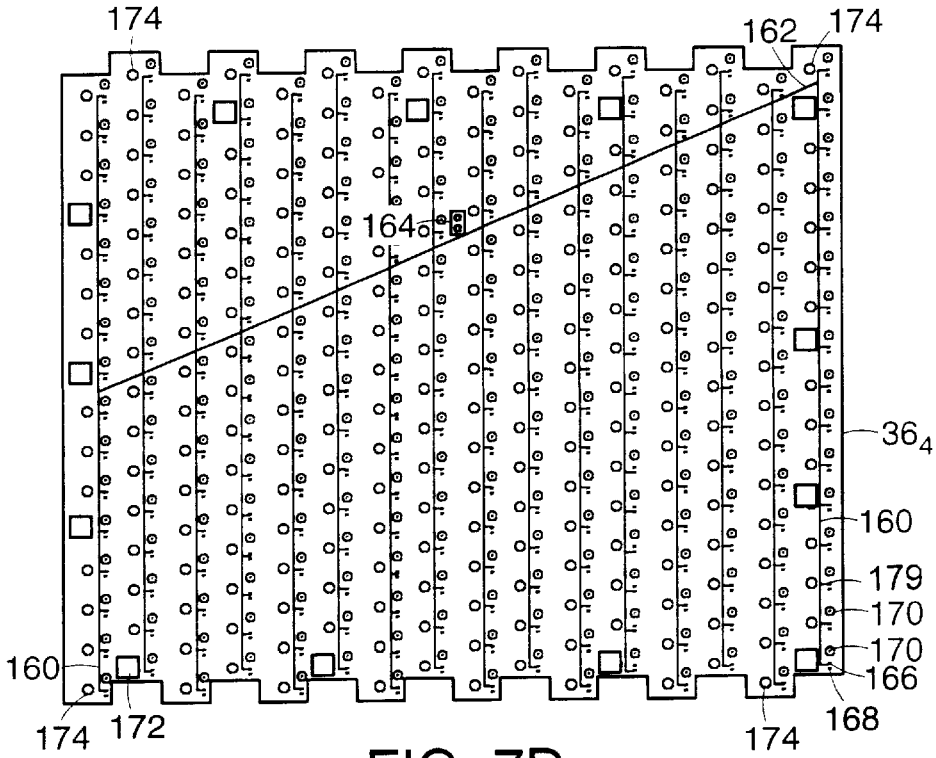
Figure 7E:
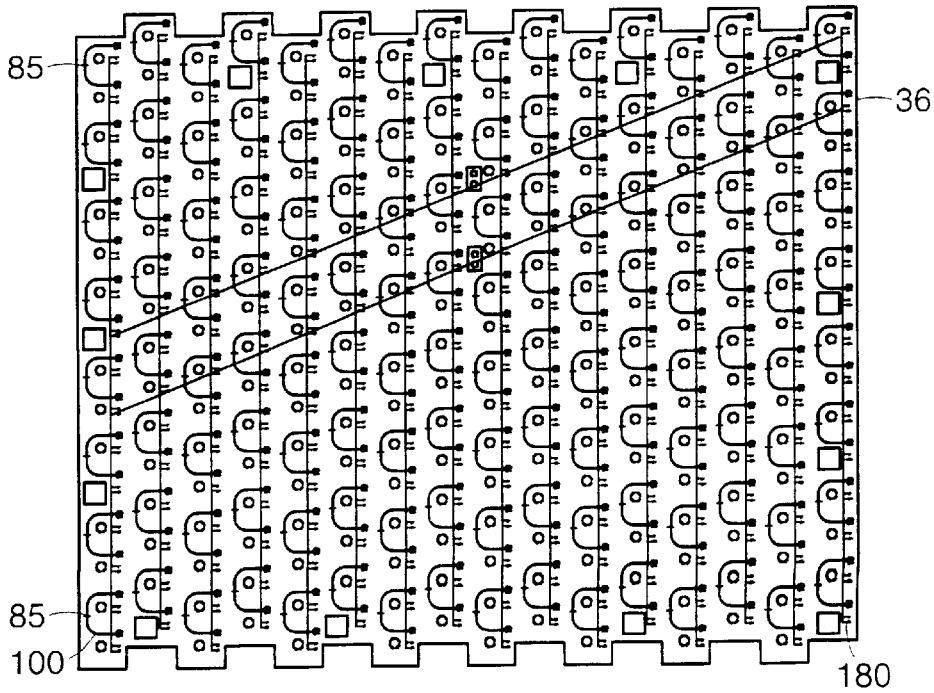

Referring next to FIG. 7, the DC/RF distribution layer section 36 is shown to include: an RF distribution layer $\mathbf{36}_1$ (FIG. 7A), a ground plane layer $\mathbf{36}_2$ (FIG. 7B), a +5 Volt bus layer $\mathbf{36}_3$ (FIG. 7C), and a −5 Volt bus layer $\mathbf{36}_4$ (FIG. 7D). FIG. 7E shows the overlaying relationship among layers $\mathbf{36}_1$–$\mathbf{36}_4$.

Referring to FIG. 7A, the RF distribution layer $\mathbf{36}_1$ is a printed circuit board and includes strip conductors patterned, as shown, to provide an array of, here 128 (i.e, 16 columns) of 2:1 power combiners 100. When assembled, each power combiner 100 has its center 102 in registration with one of the 128 distal ends 92 of the power divider/combiners 82, as shown in FIG. 7E. The layer $\mathbf{36}_1$ includes cutouts 104 for cold-plate 18 mounting hardware (not shown), +5 Volt DC pad/plated through-holes 106, −5 Volt DC pad/plated through-holes 108, 16 columns of holes 110 for the thermally conductive posts 24 (FIG. 1A), coax holes 112 for RF pins at the outputs of the power combiners 100, and pairs of holes for DC bias pins 114, 116.

Referring to FIG. 7B, the ground plane conductive layer $\mathbf{36}_2$ includes cutouts 120 for cold-plate 18 mounting hardware (not shown), +5 Volt DC plated through-holes 122, −5 Volt DC plated through-holes 124, 16 columns of holes 126 for the thermally conductive posts 24 (FIG. 1A), coax holes 128 for the RF pins 110, and pairs of plated through-holes 130, 132 for the DC bias pins 114, 116.

Referring to FIG. 7C, the +5 Volt DC distribution layer $\mathbf{36}_3$ is a printed circuit board and includes a plurality of DC buses 140 arranged in, here, 16 columns, an additional DC bus 142 running oblique to, and electrically connected to the columns of buses 140 and connected to a +5 Volt DC connector pad/bus 144. The layer $\mathbf{36}_3$ includes plated through holes 146 for the +5 Volt DC connector, pairs of plated through holes 148, 150 for the DC bias pins 114, 116, coax holes 151 for the RF pins 122, cutouts 152 for cold-plate 18 mounting hardware (not shown), and 16 columns of holes 156 for the thermally conductive posts 24 (FIG. 1A).

Referring to FIG. 7D, the −5 Volt DC distribution layer $\mathbf{36}_4$ is a printed circuit board and includes a plurality of, here 16 columns of, DC buses 160 arranged in, here, 16 columns, an additional DC bus 162 running oblique to, and electrically connected to the columns of buses 160 and connected to a −5 Volt DC connector pad/bus 164. The layer $\mathbf{36}_4$ includes pairs of plated through holes 166, 168 for DC pins 114, 116, coax holes 170 for RF pins 173, cutouts 172 for cold-plate 18 mounting hardware (not shown), and 16 columns of holes 174 for the thermally conductive posts 24. As noted from FIG. 7E: pairs of the RF pins 76 are in registration with the outputs of the 2:1 combiners 100 (FIG. 7A), and the DC bias pins 114, 116 are in registration with tabs 179, 181 on the DC buses 140, 160, respectively, as shown. Further, the slots 85 (FIG. 8D) in the RF manifold 38 are in registration with the centers of the 2:1 power combiners 100 (FIGS. 7A and 7E). Also the columns of +5 and −5 volts buses 140, 160 are in registration with each other, except for the oblique buses, albeit that the buses are dielectrically septated by the dielectric layers of their printed circuit boards.

Referring now to FIG. 6, the upper surface 20 of the active components layer section 34 is shown; the bottom surface 72 being shown in FIG. 6A; the side view being shown in FIG. 6C. Section 34 is an electrically and thermally conductive member which provides the cold-plate 18. As shown in FIG. 6, the upper surface 20 has an array of, here 16 columns, of walled pockets 180 (an exemplary one being shown in FIG. 6"). Each one of the walled pockets 180 is configured to receive a corresponding one of the phase shifter sections 16, an exemplary one of the phase shifter sections 16 being shown in FIG. 6A. The bottom 20 (FIGS. 6, 6', 6") of each pocket 180 has a pair of DC power pins 182, 184, and an RF coaxial connector 186. The phase shifter sections 16 each includes chip capacitors 190, amplifiers 192, a multifunction microwave monolithic integrated circuit (MMIC) chip 194 connected to DC power pins 182, 184 and RF coaxial connector 186 and an RF radiator 196. The back surface 22 (FIG. 6') of the active components layer section 34 is formed with the 16 columns of thermally conductive posts 24 extending outwardly therefrom perpendicular to the back surface 22 of the cold-plate 18. Thus, heat generated by the active components of the phase shifter sections 16 is removed via the thermally conductive posts 24 of the heat sink plate 28 (FIGS. 1 and 9). The section 34 includes female threaded mounting posts 200, as shown. The top view of the section 34 with the phase shifter sections 16 mounted in the pockets 180 thereof is shown in FIG. 6B.

Figure 5B:
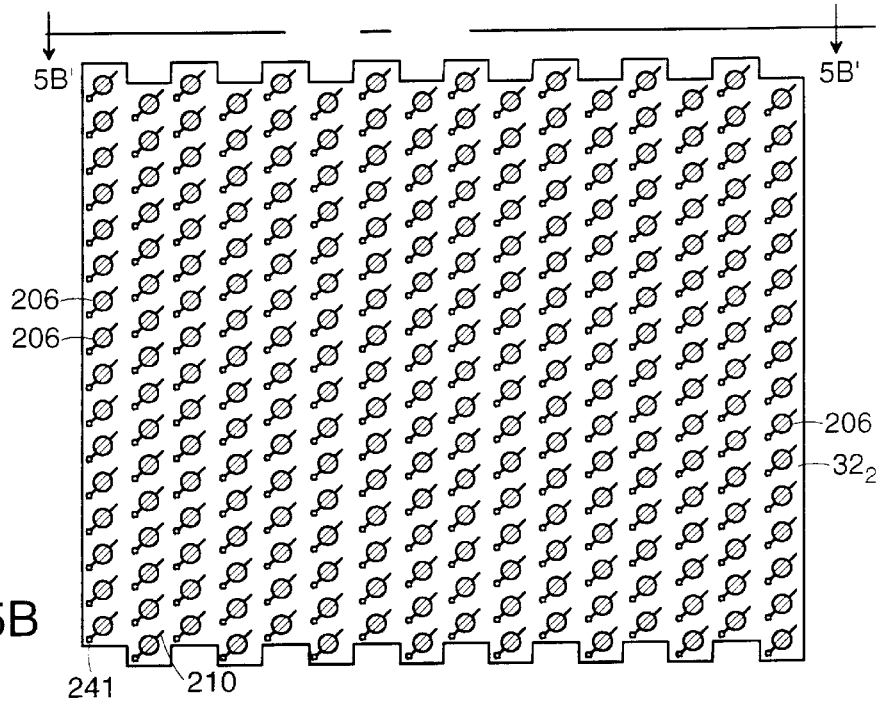
FIG. 5B is a plan view of an isolator components layer.
Figure 5B:
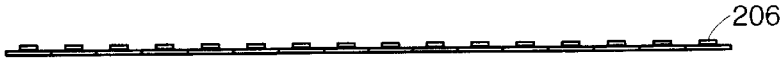
Figure 5C:
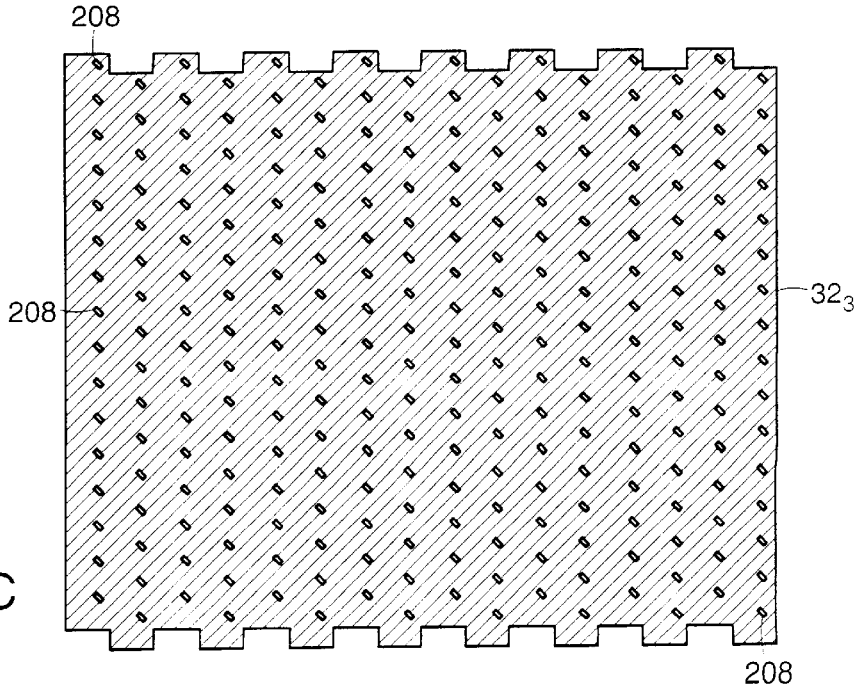
FIG. 5C is a plan view of a slot coupler layer (i.e., an active components layer interface)

Referring now to FIG. 5, the isolator layer section 32 is shown to include a spacer layer $\mathbf{32}_1$ (FIGS. 5A, 5A'), an isolator layer $\mathbf{32}_2$ (FIGS. 5B, 5B'), and an active components/slot coupler layer $\mathbf{32}_3$ (FIG. 5C).

Referring to FIGS. 5A and 5A', the spacer layer $\mathbf{32}_1$ an electrically conductive member having an array of square cavities 204 formed therethrough which serve as septums between adjacent cavities 204. As shown in FIGS. 5B and 5B', the isolator layer $\mathbf{32}_2$ is a printed circuit board having an array of 16 columns of RF ferrite isolators 206 formed on the upper surface thereof. As shown in FIG. 5C, the active components/slot coupler layer $\mathbf{32}_3$ is a conductive layer having an array of slots 208 formed therein. As shown in FIG. 5D, the array of square cavities 204 in the spacer $\mathbf{32}_1$ serve as septums for the isolators 206 and structure for mounting the contiguous layer $\mathbf{30}_5$. Further, the slots 208 are in registration with the inputs 210 of the isolators 206. The slots 206 are also in registration with the antennas 192 (FIG. 6C).

Figure 4B:
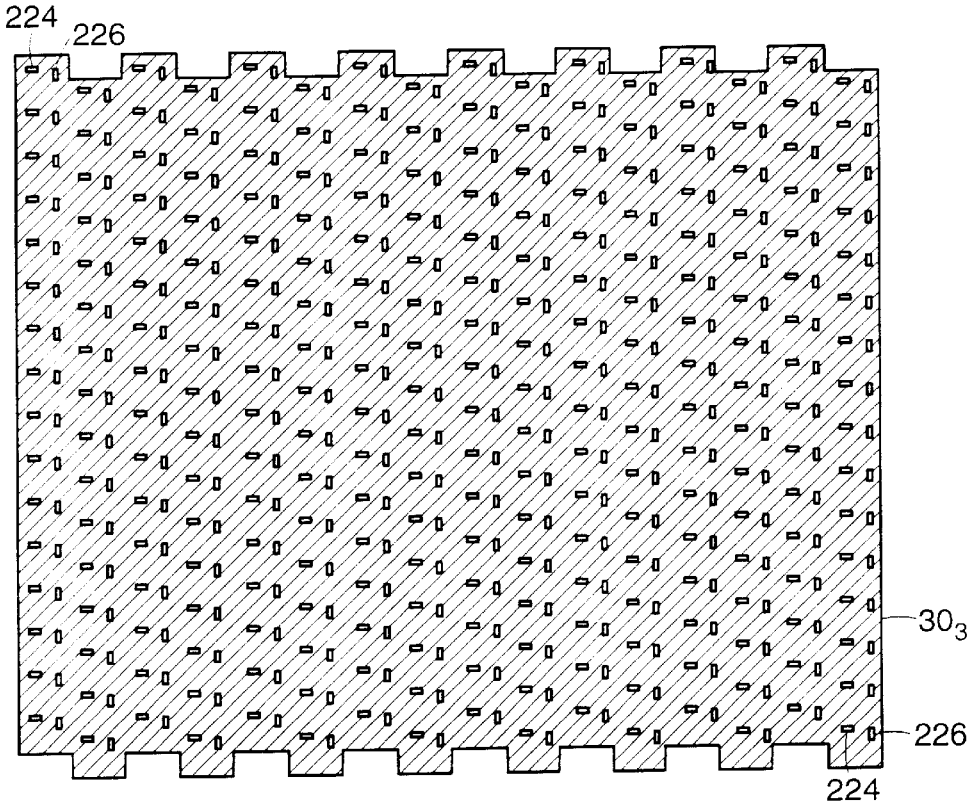
FIG. 4B is a plan view of a circular polarized slot feed layer.
Figure 4C:
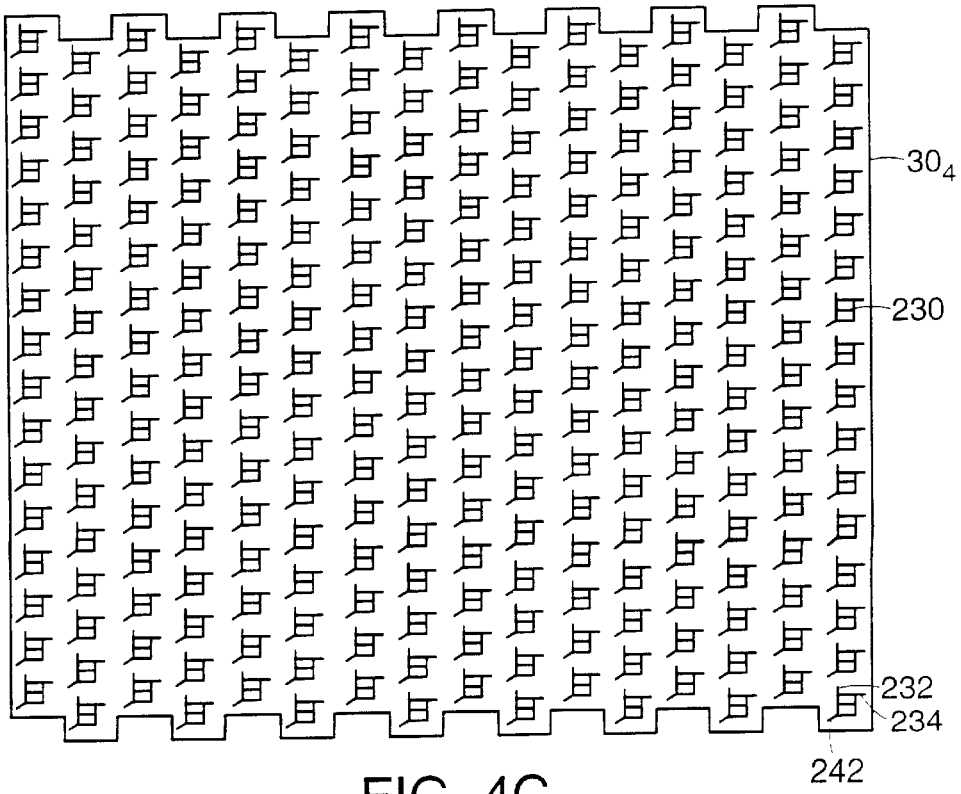
FIG. 4C is a plan view of a hybrid layer.
Figure 4D:
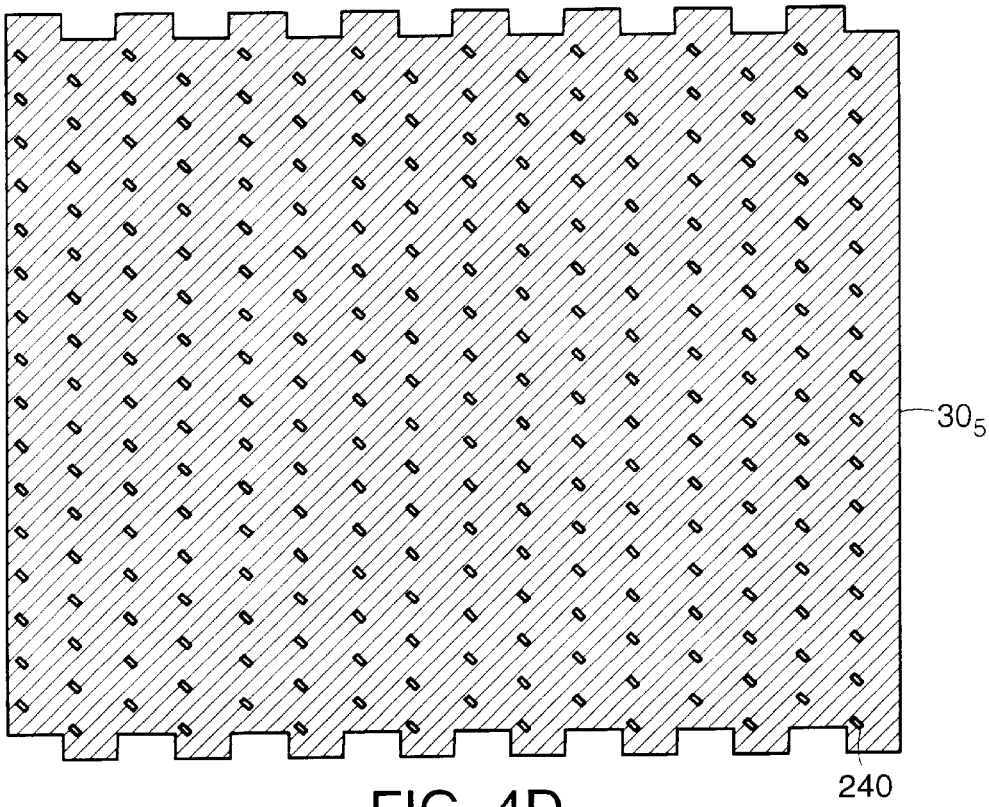
FIG. 4D is a plan view of a slot coupler layer and FIG. 4E is a plan view of the front end layer section.
Figure 4E:
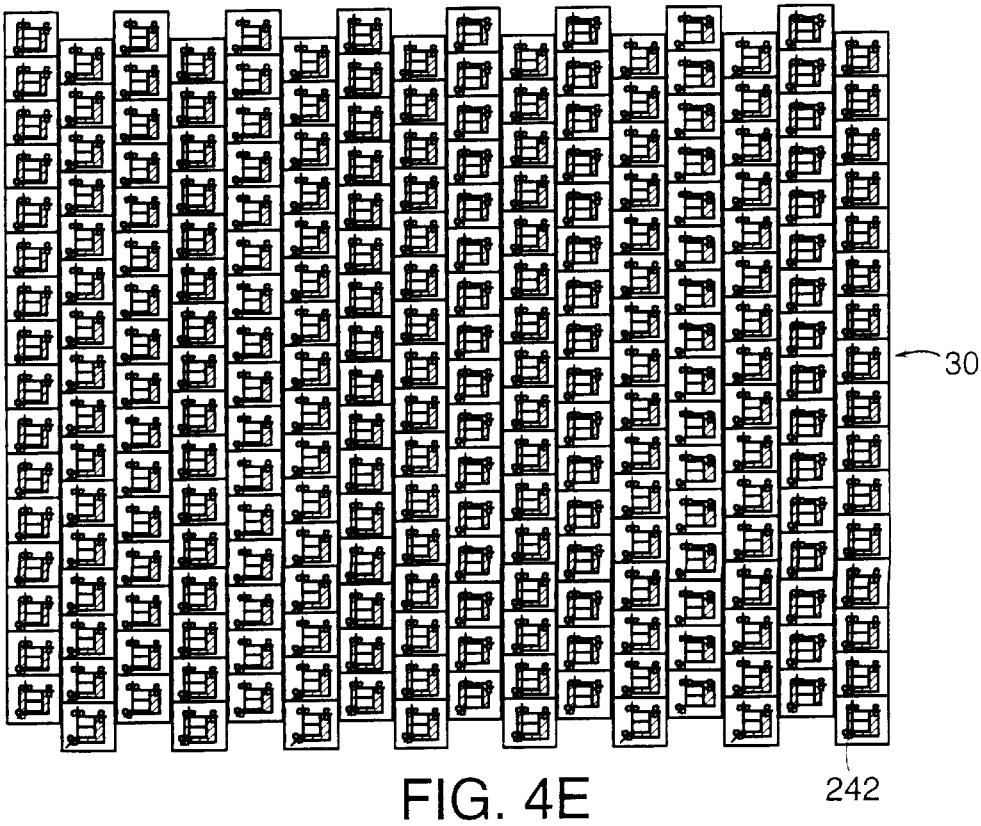

Referring now to FIG. 4, the front end layer section 30 is shown. As shown, the front end layer section 30 includes a patch radiator layer $30_1$ (FIG. 2) an air cavity layer $30_2$ (FIG. 4A), a circularly polarized slot feed layer $30_3$ (FIG. 4B), a hybrid polarizer layer $30_4$ (FIG. 4C) and a slot coupler layer $30_5$ (FIG. 4D). FIG. 4E shows the registration of layers $30_1$–$30_5$.

Figure 2:
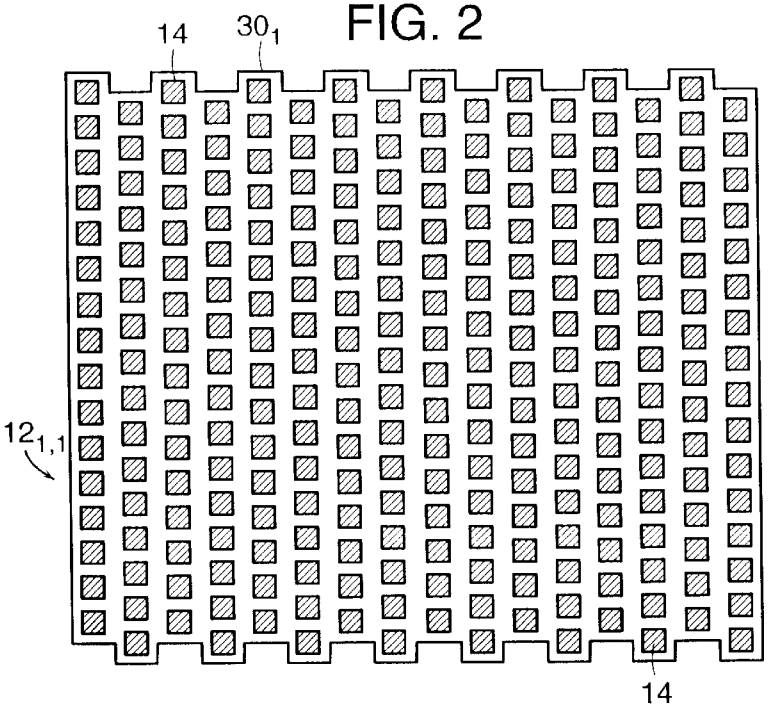
FIG. 2 is a plan view of an exemplary one of an array of phased array subassemblies of the phased array antenna of FIG. 1.
Figure 2A:
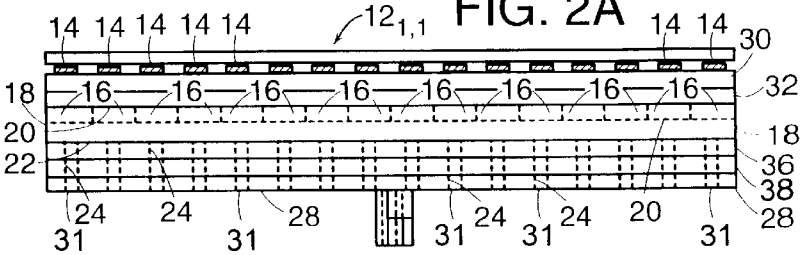
FIG. 2A' is a side elevation view of the phased array subassembly of FIG. 1A'.

As shown in FIG. 2 the patch radiator layer has the array of 16 columns of antenna elements 14. Referring to FIGS. 4A and 4A', the air cavity layer $30_2$ is an electrically conductive member having an array of square cavities (i.e., air-filled cavity) 220 formed therethrough, each in registration with a corresponding one of the antenna elements 16. Referring to FIG. 4B, the circularly polarized slot fed layer $30_3$ is a conductive layer having pairs of orthognal slots 224, 226 formed therein for each one of the antenna elements 16. Referring to FIG. 4C, the hybrid polarizer layer $30_4$ is a printed circuit board having an array of 16 columns of hybrids 230 formed thereon. As shown, each one of the hybrids 230 has a pair of outputs 232, 234 in registration with the pair of orthognal slots 224, 226. Referring to FIG. 4D, the slot coupler layer $30_5$, includes an array of slots 240. As shown in FIG. 4E, each one of the slots 240 is in registration with the input 242 of an associated hybrid 230 and an associated one of the outputs 241 of the isolators 206 (FIGS. 5B and 5D).

It should be noted that a plurality of conductive plated through holes, not shown, are used to provide ground plane continuity between the multi-level printed circuit boards. Thus, the conductive plated through holes, not shown, pass through the dielectric portion of layers $30_3$, $30_4$, $30_5$ (FIG. 4) to provide electrical connection between conductive layers $30_2$, $30_3$ and $30_5$. The conductive plated through holes, not shown, of layer $30_5$ electrically connect to conductive layer $32_1$. The conductive plated through holes, not shown, of layer $32_3$ (FIG. 5) electrically connect to the conductive cold plate 18 (FIG. 6). Also conductive plated through holes, not shown, pass through the dielectric portion of layer $32_2$ (FIG. 5) to electrically interconnect layer $32_1$ to conductive layer $32_3$. The thermally conductive posts 24, and hardware, not shown, electrically connect the heat sink plate 28 (FIG. 9) to the cold plate 34. Conductive plated through holes, not shown, pass through the dielectric portion of layers $36_3$, $36_4$ (FIG. 7) to provide electrical connection between conductive layer $36_2$ and cold plate 28. Conductive plated through holes, not shown, pass through the dielectric layers $38_1$, $38_2$ and $38_3$ (FIG. 8) to provide electrical contact between the heat sink plate 28 and layers $38_2$ and $38_4$.

Figure 11:
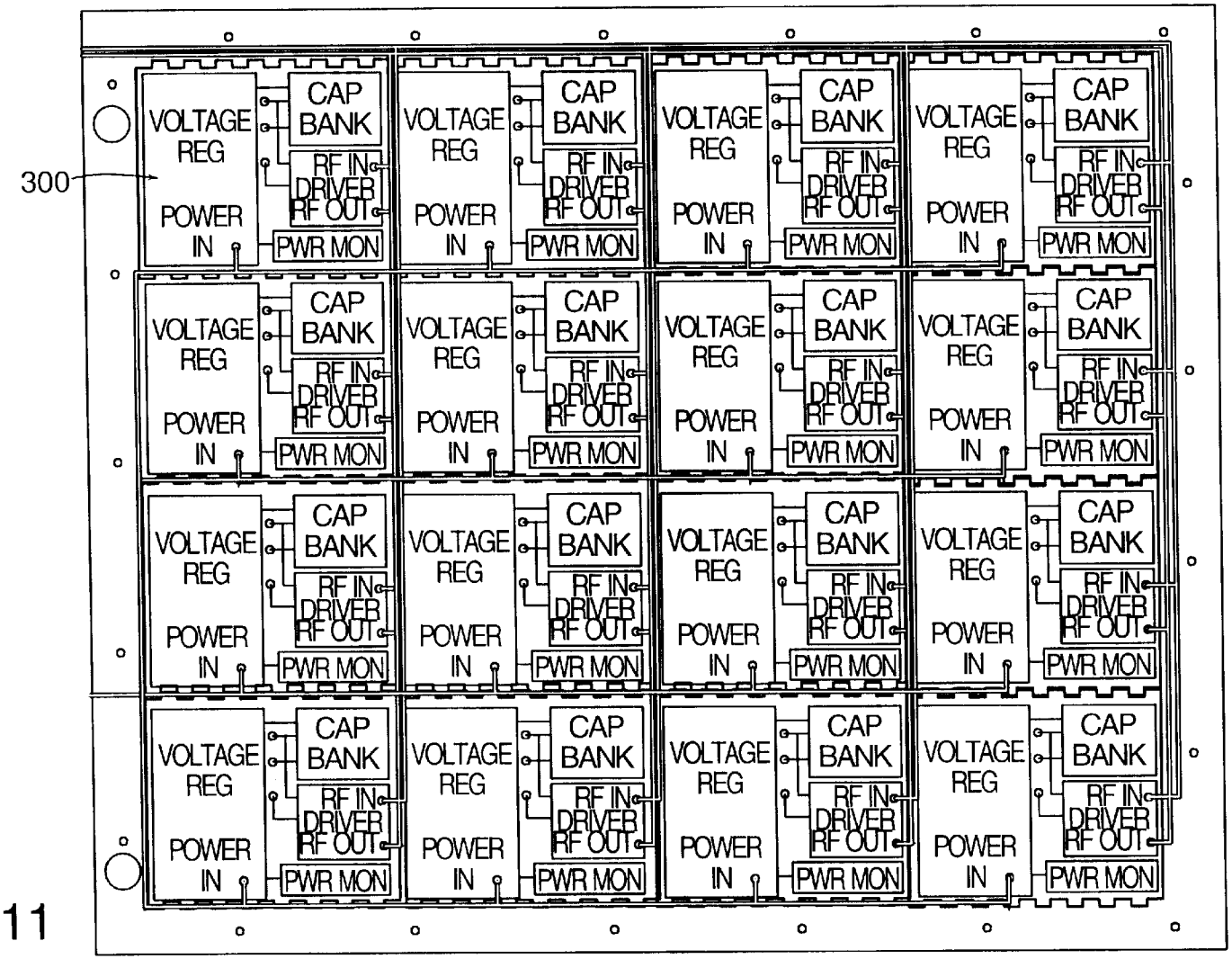
FIG. 11 is a sketch showing an array of electronic sections for the array of phased array subassemblies of FIG. 1A.

Referring now to FIG. 11, an array of electronic sections 300 is mounted to the rear of the baseplate 43, as shown. Here, the phased array antenna 10 (FIG. 1) is fed phase shift and controls using the system described in co-pending patent application entitled "Antenna System", inventors Irl W. Smith, L. E. Andre' Brunel and Robert P. Zagrodnick, assigned to the same assignee as the present invention and filed May 17, 1996, the entire contents thereof being incorporated herein by reference.

In operation, and considering transmission while recognizing that the reciprocal operation applies during reception, RF energy fed RF connector 46 (FIGS. 9' and 9") is coupled to conductive pad 52 (FIG. 8A), feed line 54, coupling slot 64 (FIG. 8B), center region 113 (FIG. 8E) to the power divider/combiner 82. The RF energy is then distributed, with equal power and phase, to distal ends 92 of the divider/combiner 82. The RF energy at distal ends 92 is then coupled via slots 85 (FIG. 8D) to center regions 102 of power combiners 100 (FIGS. 7A, 7E). The RF energy is coupled to ends thereof and, one end of coax feedthrough pin 186 to the other end of the coax feedthrough pin 186 to the MMIC chip 194 (FIG. 6C) of phase shifter section 16 (FIG. 6C). The phase shifted energy is radiated by RF radiator 196. The radiated energy from radiator 196 passes through slot 208 (FIG. 5C) associated therewith to the input 210 of the ferrite isolator 206 associated therewith (FIGS. 5B. 5B', 5C). The output 241 of the associated isolator 206 is fed via slot 240 (FIG. 4D) to the input 242 of the associated hybrid (FIG. 4C). The output 232, 234 of the hybrid are coupled through slots 224, 226, (FIG. 4B) respectively. The RF energy radiating through slots 224, 226 into the associated air-filled cavity 220 is coupled to the associated antenna element 14. The arrangement is shown more clearly in FIGS. 4E' and 4E" for an exemplary antenna element 14. Thus, the antenna element includes a dielectric layer 500 having a patch conductor 502, as shown. Disposed behind the patch conductor 502 is an associated air-filled cavity 220 provided by air cavity layer $30_2$. Disposed behind the associated air cavity 220 is a printed circuit board 504 having a conductive layer 506 with slots 224, 226 formed therein (i.e, section $30_3$). Disposed on the back side of the printed circuit board 504 are slots 224, 226, such slots 224, 226 being in registration with the outputs 232, 234 of the hybrid 230, as shown.

Other embodiments are within the spirit and scope of the appended claims.

What is claimed is:

1. A phased array antenna, comprising:

an array of antenna elements having multiple layer sections;

an array of phase shifter sections each one thereof being associated with a corresponding one of the antenna elements in the array thereof;

an electrically and thermally conductive cold-plate having a pair of opposing surfaces, one of the opposing surfaces having the array of phase shifter sections mounted, and thermally coupled thereto and an opposite one of the pair of opposing surfaces having thermally conductive posts with proximal ends thermally connected to the opposite one of the opposing surfaces and projecting outwardly therefrom;

a heat sink plate thermally coupled to distal ends of the posts, and a power/radio frequency energy distribution section mounted to said opposite one of the pair of cold-plate surfaces for distributing power and radio frequency energy among the phase shifter sections mounted to the cold-plate.

2. The phased array antenna recited in claim 1 wherein the cold-plate has a plurality of feeds passing therethrough, a set of such feeds being associated with a corresponding one of the phase shifter sections, a pair of such feeds in each set thereof being adapted to provide power to the associated one of the phase shifter sections and another one of the feeds in the set thereof being adapted to couple therethrough radio frequency energy associated with such one of the phase shifter sections.

3. The phased array antenna recited in claim 2 wherein the plurality of feeds extend through the cold-plate along a direction parallel to the posts.

4. The phased array antenna recited in claim 1 wherein the power/radio frequency energy distribution section comprises a plurality of stacked printed circuit boards and wherein the posts pass through the stacked printed circuit boards to the heat sink plate.

5. The phased array antenna recited in claim 4 including an antenna section comprising the array of antenna elements, such antenna section being mounted to the first mentioned surface of the cold-plate.

6. The phased array antenna recited in claim 4 wherein the array of antenna elements are arranged in columns and wherein one of the stacked, power/radio frequency energy distribution section printed circuit boards includes a plurality of voltage buses disposed in columns and an additional bus disposed obliquely to, and electrically interconnecting, the plurality of voltage buses.

7. The phased array antenna recited in claim 6 wherein a second one of the stacked, power/radio frequency energy distribution section printed circuit boards includes a plurality of second voltage buses disposed in columns and an additional second bus disposed obliquely to, and electrically interconnecting, the plurality of second voltage buses.

8. The phased array antenna recited in claim 7 wherein the heat sink plate has a radio frequency connector and wherein the power/radio frequency energy distribution section is coupled to the radio frequency connector and wherein radio frequency energy fed to the radio frequency connector is coupled to the phase shifter sections though coupling slots provided in the stacked, power/radio frequency energy distribution section printed circuit boards.

9. The phased array antenna recited in claim 1 wherein each one of the posts is disposed behind a corresponding one of the plurality of mounted phase shifter sections and through the multiple layer sections.

10. An array of antenna elements, comprising:

an array of patch radiators;

an electrically and thermally conductive layer having an array of cavities disposed therein, each one of the patch radiators in the array thereof being disposed over an associated one of the cavities;

an array of phase shifter sections, each one of the phase shifter sections in the array thereof corresponding to one of the cavities;

multiple overlaying layers;

a conductive cold-plate having a pair of opposing surfaces, one of the opposing surfaces having the array of phase shifter sections mounted and thermally coupled thereto, and coupled to corresponding ones of the patch radiators in the array of patch radiators and an opposite one of the pair of opposing surfaces having thermally conductive posts with proximal ends thermally connected to the opposite one of the opposing surfaces and projecting outwardly therefrom, each of the posts being disposed behind a corresponding one of the plurality of mounted phase shifter sections and through the multiple overlaying layers;

a heat sink plate thermally coupled to distal ends of the posts; and wherein the multiple overlaying layers comprises a power/radio frequency energy distribution section mounted to said opposite one of the pair of cold-plate surfaces for distributing power and radio frequency energy among the phase shifter sections mounted to the cold-plate.

11. The array of antenna elements recited in claim 10 wherein the power/radio frequency distribution section includes an RF feed for each one of the cavities.

12. The array of antenna elements recited in claim 11 wherein each RF feed includes a pair of orthogonal slots.

13. The array of antenna elements recited in claim 10 further comprising an array of isolators disposed on a common substrate between the array of patch radiators and the array of phase shifter sections, each isolator being electrically coupled to a corresponding patch radiator and a corresponding phase shifter section.

14. A phased array antenna, comprising:

an array of antenna elements;

an array of phase shifter sections each one thereof being associated with a corresponding one of the antenna elements in the array thereof, each one of the phase shifter sections having a microwave monolithic integrated circuit;

an electrically and thermally conductive member having a plurality of pockets, each one of such pockets corresponding to a phase shifter section of the array of phase shifter sections, each pocket including side walls and a bottom wall, each one of the array of phase shifter sections being mounted, and thermally coupled, to one surface of the bottom wall of a corresponding one of the pockets, the microwave monolithic integrated circuit of each phase shifter section being thermally coupled to the bottom wall; and a power/radio frequency energy distribution section mounted to an opposite surface of the bottom wall of each one of the pockets for distributing power and radio frequency energy among the phase shifter sections mounted to the conductive member.

15. The phased array antenna recited in claim 14 wherein the conductive member has a plurality of feeds passing therethrough, a set of such feeds being associated with a corresponding one of the phase shifter sections, a pair of such feeds in each set thereof being adapted to provide power to the associated one of the phase shifter sections and another one of the feeds in the set thereof being adapted to couple therethrough radio frequency energy associated with such one of the phase shifter sections.

16. The phased array antenna recited in claim 15 wherein the plurality of feeds extend through the conductive member.

17. A phased array antenna, comprising:

an array of antenna elements;

an array of phase shifter sections, each one thereof being associated with a corresponding one of the antenna elements;

an electrically conductive member having a plurality of pockets each one thereof corresponding to a phase shifter section of the array of phase shifter sections, each pocket including side walls and a bottom wall, each one of the array of phase shifter sections being disposed on, and mounted to, one surface of the bottom wall of a corresponding one of the pockets;

thermal conductors connected to the array of phase shifter sections and extending away from the bottom walls of the pockets; and a power/radio frequency energy distribution section mounted to an opposite surface of the bottom wall of each one of the pockets for distributing power and radio frequency energy among the phase shifter sections mounted to the conductive member.

18. The phased array antenna recited in claim 17 wherein a heat sink plate is thermally coupled to distal ends of the thermal conductors.

19. The phased array antenna recited in claim 17, wherein the power/radio frequency energy distribution section comprises a plurality of stacked printed circuit boards and wherein the thermal conductors pass through the stacked printed circuit boards to a heat sink plate.

20. The phased array antenna recited in claim 19 including an antenna section comprising the array of antenna elements, such antenna section being mounted to a surface of the conductive member.

21. The phased array antenna recited in claim 20 wherein the array of antenna elements are arranged in columns and wherein one of the stacked, power/radio frequency energy distribution section printed circuit boards includes a plurality of voltage buses disposed in columns and an additional bus disposed obliquely to, and electrically interconnecting, the plurality of voltage buses.

22. The phased array antenna recited in claim 21 wherein a second one of the stacked, power/radio frequency energy distribution section printed circuit boards includes a plurality of second voltage buses disposed in columns and an additional second bus disposed obliquely to, and electrically interconnecting, the plurality of second voltage buses.

23. The phased array antenna recited in claim 22 wherein the heat sink plate has a radio frequency connector and wherein the power/radio frequency energy distribution section is coupled to the radio frequency connector and wherein radio frequency energy fed to the radio frequency connector is coupled to the phase shifter sections though coupling slots provided in the stacked, power/radio frequency energy distribution section printed circuit boards.

* * * * *